US009850691B2

(12) United States Patent
Nakasone

(10) Patent No.: US 9,850,691 B2
(45) Date of Patent: Dec. 26, 2017

(54) LOCK DEVICE FOR OPENING/CLOSING BODY

(71) Applicant: PIOLAX, INC., Yokohama-shi (JP)

(72) Inventor: Hisashi Nakasone, Yokohama (JP)

(73) Assignee: PIOLAX, INC., Yokohama-Shi, Kanagawa (JP)

( * ) Notice: Subject to any disclaimer, the term of this patent is extended or adjusted under 35 U.S.C. 154(b) by 209 days.

(21) Appl. No.: 14/406,742

(22) PCT Filed: Jun. 11, 2013

(86) PCT No.: PCT/JP2013/066024
§ 371 (c)(1),
(2) Date: Dec. 9, 2014

(87) PCT Pub. No.: WO2013/187388
PCT Pub. Date: Dec. 19, 2013

(65) Prior Publication Data

US 2015/0152671 A1 Jun. 4, 2015

(30) Foreign Application Priority Data

Jun. 15, 2012 (JP) ..... 2012-136219
Jan. 8, 2013 (JP) ..... 2013-001326

(51) Int. Cl.
*E05C 1/12* (2006.01)
*E05B 83/30* (2014.01)
(Continued)

(52) U.S. Cl.
CPC ..... *E05B 83/30* (2013.01); *E05B 1/0038* (2013.01); *E05C 9/041* (2013.01); *E05C 9/042* (2013.01); *Y10T 292/0977* (2015.04)

(58) Field of Classification Search
CPC ..... E05B 83/30; E05B 63/22; E05B 65/087; E05C 1/16; E05C 292/0961
(Continued)

(56) References Cited

U.S. PATENT DOCUMENTS 5,584,098 A 12/1996 Koyama et al.
2007/0080542 A1* 4/2007 Ookawara ..... E05B 83/30 292/36
(Continued)

FOREIGN PATENT DOCUMENTS

CN 1982640 A 6/2007
CN 102171407 A 8/2011
(Continued)

OTHER PUBLICATIONS

International Search Report (ISR) (PCT Form PCT/ISA/210), in PCT/JP2013/066024, dated Sep. 17, 2013.
(Continued)

*Primary Examiner* — Mark Williams
(74) *Attorney, Agent, or Firm* — McGinn IP Law Group, PLLC.

(57) ABSTRACT

A lock device is provided with a housing, a rotary member, a pair of link rods provided with a hook part, a spring for the rotary biasing of the rotary member, and an operative member mounted so as to be able to be inserted into the housing. A cam protrusions formed in the rotary member, and a wall part having a cam slope which abuts the cam protrusion is formed in the operative member. The configuration is such that by inserting the operative member, the rotary member resists the biasing force of the spring and rotates, and the hook part of the link rods slides in a position in which it does not engage with the lock part.

17 Claims, 25 Drawing Sheets

(51) Int. Cl.
*E05C 9/04* (2006.01)
*E05B 1/00* (2006.01)

(58) Field of Classification Search
USPC ..... 292/169
See application file for complete search history.

(56) References Cited

U.S. PATENT DOCUMENTS

| | | | |
|---|---|---|---|
| 2011/0174027 | A1 | 7/2011 | Ookawara et al. |
| 2015/0008680 | A1 | 1/2015 | Suzuki |

FOREIGN PATENT DOCUMENTS

| | | | |
|---|---|---|---|
| JP | UM-S57-046647 | A | 3/1982 |
| JP | S 62-237107 | A | 10/1987 |
| JP | S 62-280474 | A | 12/1987 |
| JP | UM-H01-013845 | B | 4/1989 |
| JP | H 07-228131 | A | 8/1995 |
| JP | H 11-350816 | A | 12/1999 |
| JP | 2007-100343 | A | 4/2007 |
| JP | 4173400 | B | 10/2008 |
| JP | 2011-034428 | A | 2/2011 |
| JP | 4717823 | B | 7/2011 |
| WO | WO 2013/118326 | A1 | 8/2013 |

OTHER PUBLICATIONS

Japanese Office Action dated Aug. 4, 2015 with an English translation thereof.
Third Party Submission of Publication and the like dated Mar. 19, 2015 with an English translation thereof.
"Technical Trend Mechanical Element Handbook with view of Patent (fixation)", pp. 54-61 and 686-687; Sep. 25, 1980.
Chinese Office Action dated Mar. 29, 2016 with an English translation thereof.

* cited by examiner

LOCK DEVICE FOR OPENING/CLOSING BODY

TECHNICAL FIELD

The present invention relates to a locking device for an openable/closable body that is used to lock an openable/closable body in a closed state, the openable/closable body being openably/closably mounted to an opening portion of a fixed body.

BACKGROUND ART

For example, an openable/closable body such as a lid may be openably/closably mounted to an opening portion provided to a fixed body such as a glove box of an automobile, and a locking device for locking the lid in a closed state where the opening portion is closed while allowing the lid to be brought into an opened state where the opening portion is opened.

The following Patent Document 1 describes a locking device for an openable/closable member, as an example of a conventional locking device of this type, that includes a locking device main body mounted on the opening portion, to which an openable/closable member is openably/closably provided, and a notch that is formed to the openable/closable member so as to surround the locking device main body when the openable/closable member is closed. The locking device main body includes a housing mounted to the supporting body, a pair of lock pins, a spring that is interposed between the pair of lock pins to outwardly bias them, and a manipulation member to pull in the pair of lock pins against the spring. The manipulation member includes a pair of pushing members including cam faces that protrude from the back surface side of the manipulation member. Each of the pair of lock pins includes an inclined surface at the base end, with which each of the cam faces is brought into slidably contact.

When the manipulation member is pushed in while the opening portion of the supporting member is closed with the openable/closable member, the cam faces of the pair of pushing members are brought into slidably contact with the inclined surfaces of the pair of lock pins, and the pair of lock pins slide in directions of approaching each other against the biasing force of the spring. Engaging hooks at the distal ends of the lock pins are pulled in from engaging holes provided on both the sides of the notch of the openable/closable member, and thereby the openable/closable member is opened.

In addition, Patent Document 2 describes a side lock device including a rotor pivotally supported on the back side of a lid, a pair of rods connected to the rotor, a knob that is pushably and pullably mounted on the front side of the lid and rotates the rotor by the pushing and pulling manipulation, and a return spring to rotatably bias the rotor. The pushing and pulling manipulation of the knob rotationally moves the rotor against the return spring to pull the rods into the lid.

It is described in one embodiment of Patent Document 2 that the rotor includes an arc-like slit and one end of the slit in the circumferential direction includes a tapered surface while the knob has a push-in structure and includes a pusher element, having a tapered pushing surface, which protrudes from the back side. Pushing in the knob makes the pushing surface of the pusher element push the tapered surface of the rotor to rotate the rotor, and thereby the pair of rods are pulled in inwardly of the lid.

CITATION LIST

Patent Literature

Patent Document 1
JP-4173400-B
Patent Document 2
JP-2007-100343-A

SUMMARY OF THE INVENTION

Problem that the Invention is to Solve

In the locking device disclosed in Patent Document 1, the lock pins are arranged to slide separately in response to the respective pushing members provided to the manipulation member. For this reason, when the openable/closable member is pushed in while the opening portion of the supporting member is opened, the distal ends of the lock pins are pressed by both the sides of the notch, and the lock pins separately slide inwardly of the locking device main body against the biasing force of the spring. Then, when the distal ends of the lock pins are disposed in the engaging holes on both the sides of the notch, the lock pins are pushed out outwardly of the locking device main body by the biasing force of the spring to separately engage the engaging holes.

However, because the lock pins separately slide in the above-described locking device, only one of the lock pins could engage one of the engaging holes, that is, so-called one-side engagement could occur, when the opening portion of the supporting member is being closed with the openable/closable member.

In addition, while the side lock device disclosed in Patent Document 2 has the configuration that the pusher element pushes the tapered surface of the rotor to rotate the rotor when the knob is pushed in, it is difficult to form the tapered surface long because the tapered surface is provided at one end of the arc-like slit in the circumferential direction. As a result, the contact length between the tapered surface and the pusher element is not secured easily, which could cause difficult rotation of the rotor.

Thus, an object of the present invention is to provide a locking device for an openable/closable body in which one-side engagement of hook portions of a pair of link rods with a locking portion can be prevented, and the length of a cam inclined surface can be secured long to reliably rotate a rotary member by pushing in a manipulation member.

Means for Solving the Problem

To archive the above-mentioned object, the present invention provides a locking device for an openable/closable body that is openably/closably mounted to an opening portion of a fixed body, the locking device including:

locking portions provided on both sides of one of the openable/closable body and the opening portion of the fixed body;

a housing mounted to the other one of the openable/closable body and the fixed body;

a rotary member rotatably mounted to the housing;

a pair of link rods configured to slidably move in synchronization with rotation of the rotary member to make hook portions formed at distal ends thereof engage and disengage the locking portions;

a spring arranged to bias the link rods in directions that the hook portions of the link rods engage the locking portions; and a manipulation member pushably mounted to the housing, wherein one of the rotary member and the manipulation member includes a wall portion having a cam inclined surface, while the other one of the rotary member and the manipulation member includes a cam contact portion, so that a pushing force on the manipulation member is converted into a rotational force on the rotary member through contact between the cam contact portion and the cam inclined surface, and wherein, by pushing in the manipulation member, the rotary member is rotated against a biasing force of the spring, and the pair of link rods are made to slide to positions where the hook portions of the link rods disengage the locking portions.

In the prevent invention there may be provided the locking device, wherein the cam contact portion are disposed in plurality on at least two positions at regular intervals in the circumferential direction with respect to a rotation center of the rotary member.

In the prevent invention there may be provided the locking device, wherein the wall portion has one of an ark shape and a circular cylindrical shape when seen in a rotation axis direction of the rotary member, and the cam inclined surface is formed by an end face of the wall portion which gradually becomes lower in height along the circumferential direction.

In the prevent invention there may be provided the locking device, wherein the manipulation member is pushably mounted on a front surface side of the housing, and the rotary member is rotatably mounted on a back surface side of the housing.

In the prevent invention there may be provided the locking device, wherein one of the housing and the rotary member includes:

a shaft portion protruding therefrom; and a protrusion protruding from an outer circumference of a distal end portion of the shaft portion toward an outside diameter side of the shaft portion, wherein the other one of the housing and the rotary member includes:

a shaft hole into which the shaft portion is inserted; and a groove portion that communicates with the shaft hole and allows the protrusion to pass therethrough, and wherein the rotary member is retained by matching the protrusion to the groove portion, inserting the shaft portion into the shaft hole, in a state where the protrusion appears from the groove portion, rotating the rotary member in a given direction to thereby make the protrusion engage a circumference of the shaft hole.

In the prevent invention there may be provided the locking device,

The locking device of claim 5, further including:

a coil spring provided to bias the manipulation member in a direction away from the housing, wherein the shaft portion includes a supporting recess portion arranged to support one end of the coil spring.

In the prevent invention there may be provided the locking device, wherein a cylindrical portion is provided on the one of the rotary member and the manipulation member at one of an inside diameter side and an outside diameter side of the wall portion having the cam inclined surface, so as to be monolithic therewith, and wherein the cylindrical portion guides the cam contact portion when the manipulation member is pushed in to bring the cam contact portion into contact with the cam inclined surface to thereby rotate the rotary member.

In the prevent invention there may be provided the locking device, wherein the wall portion having the cam inclined surface is provided on the rotary member while the cam contact portion is provided on the manipulation member.

In the prevent invention there may be provided the locking device, wherein the rotary member is rotatably mounted between the housing and the manipulation member and inwardly of the housing.

In the prevent invention there may be provided the locking device, wherein the wall portion having the cam inclined surface is provided on the manipulation member while the cam contact portion is provided on the rotary member.

In the prevent invention there may be provided the locking device, wherein the cam contact portion has an arc-shaped distal end face that is to be brought into contact with the cam inclined surface.

In the prevent invention there may be provided the locking device, wherein the pair of link rods are pivotally mounted to the rotary member at opposite positions around the outer circumference of the rotary member.

BRIEF DESCRIPTION OF THE DRAWINGS

FIG. 2 Views of a housing that constitutes the locking device, where

FIG. 3 Views of a rotary member that constitutes the locking device, where

FIG. 4 Views of a manipulation member that constitutes the locking device, where

FIG. 9 Views of an openable/closable body that is closed by the locking device, where

FIG. 10 Views of an openable/closable body that is opened by the locking device, where

FIG. 17 Views of the locking device in a state where the manipulation member is yet to be pushed in, where

FIG. 19 A back view of the locking device in a state where the manipulation member is yet to be pushed in.

FIG. 22 Views of the locking device in a state where the manipulation member is pushed in, where

MODE FOR CARRYING OUT THE INVENTION

Hereinafter, a description of a locking device for an openable/closable body according to the first embodiment of the present invention will be provided referring to FIGS. 1 to 12.

Figure 1:
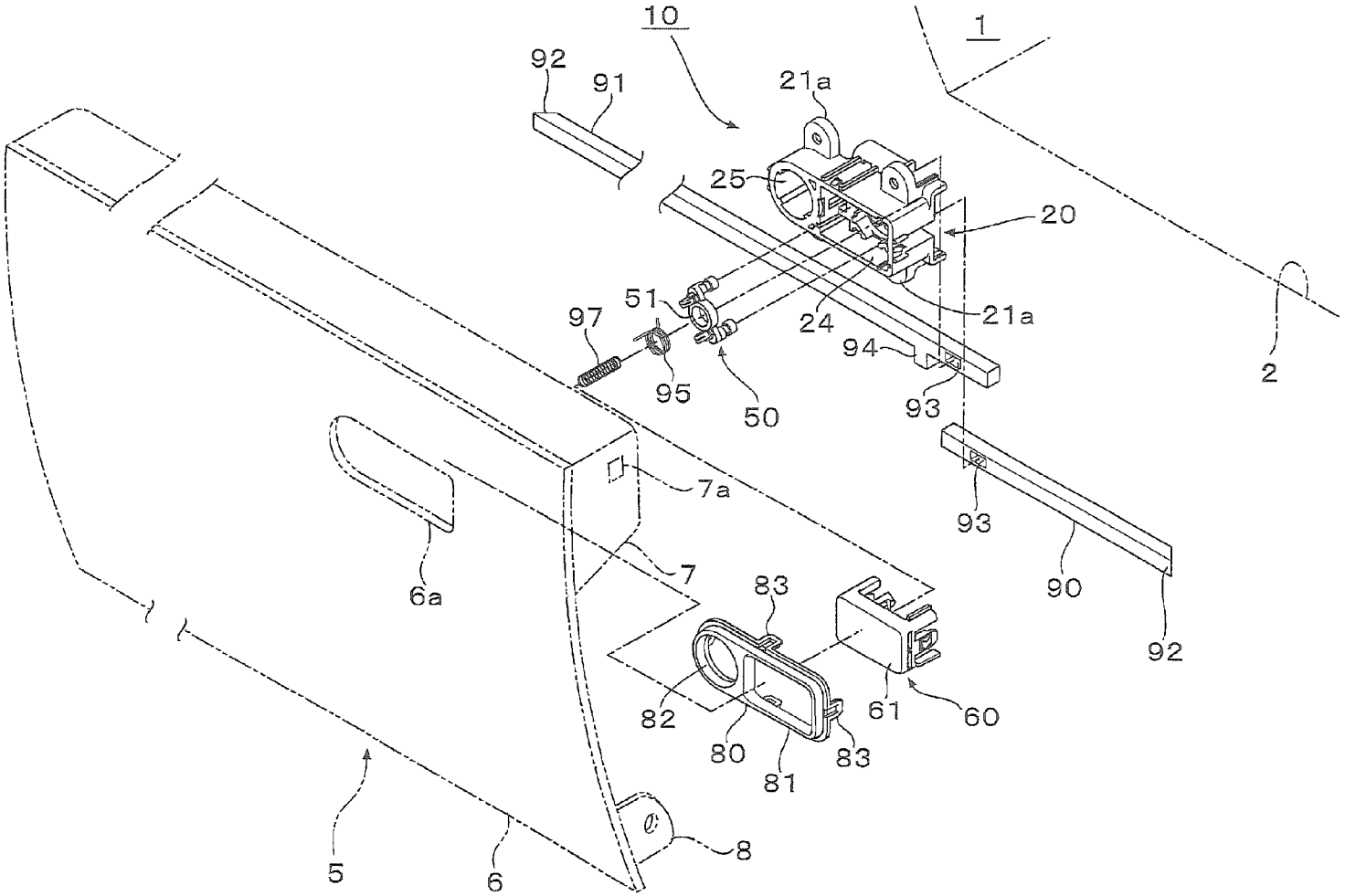
FIG. 1 An exploded perspective view of a locking device for an openable/closable body according to the first embodiment of the present invention.

As shown in FIG. 1, a locking device 10 for an openable/closable body (hereinafter, referred to as the "locking device 10") according to the present embodiment is used to lock and unlock a lid 5 (the "openable/closable body" in the present invention) that is openably/closably mounted to an opening portion 2 of a glove box 1 (the "fixed body" in the present invention) provided to an instrument panel of a vehicle.

Figure 10A:
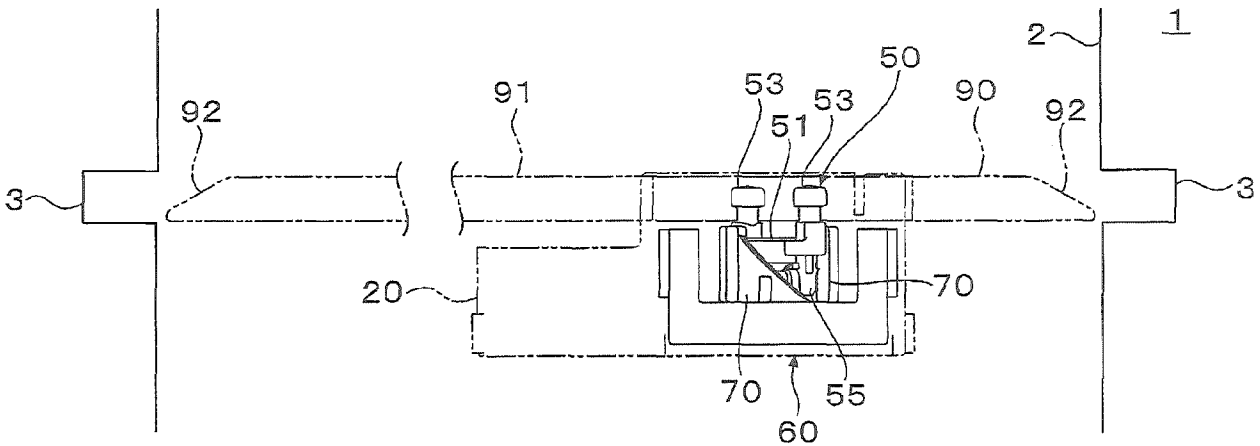
FIG. 10A is a plan view thereof.
Figure 10B:
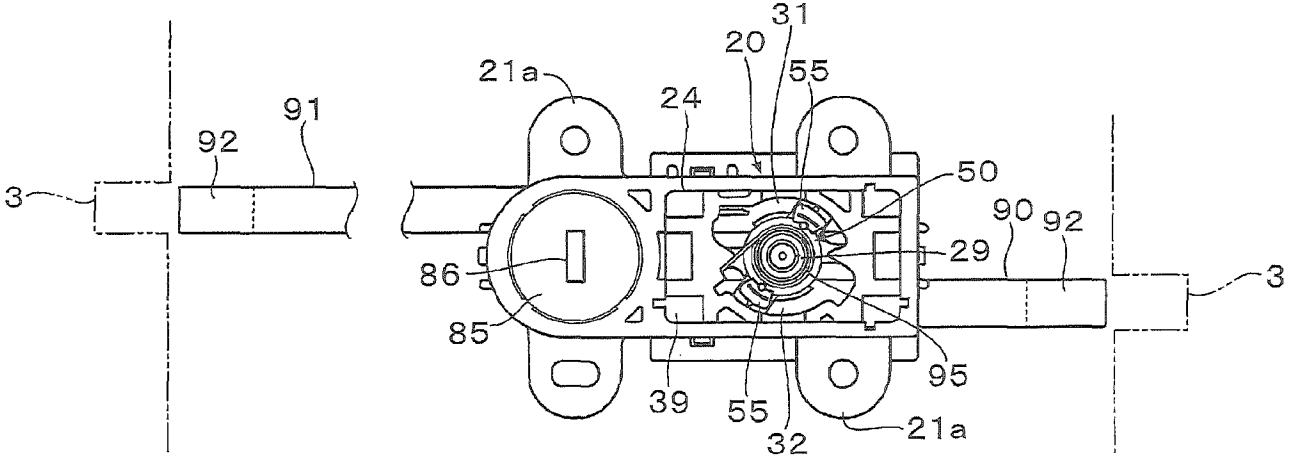
FIG. 10B is a front view thereof.

As shown in FIGS. 10A and 10B, locking portions 3 and 3 having a recess shape are provided to the opening portion 2 of the glove box 1 on both the sides on the inner surface. The lid 5 includes a panel 6 including a mounting hole 6*a* having a long hole shape and a box 7 disposed in an upper portion on the back side of the panel 6. As shown in FIG. 1, the lid 5 is openably/closably mounted to the opening portion 2 of the glove box 1 via supporting pieces 8 provided to the lid 5 on both the sides in the lower portion. The locking device 10 is disposed in an interior space between the panel 6 and the box 7. Rod in-and-out holes 7*a* and 7*a* are provided to the box 7 on both the sides in the width direction.

As shown in FIG. 1, the locking device 10 according to the present embodiment mainly includes a housing 20 mounted to the lid 5, a rotary member 50 rotatably mounted to the housing 20, a pair of link rods 90 and 91 connected to the rotary member 50, a torsion spring 95 to bias to rotate the rotary member 50 in directions such that hook portions 92 of the link rods 90 and 91 engage the locking portions 3 and 3 respectively, a manipulation member 60 pushably mounted to the housing 20 along a rotation axis direction of the rotary member 50, a bezel 80 mounted on the front surface side of the housing 20, and a coil spring 97 to bias the manipulation member 60 in a direction away from the housing 20. The rotary member 50 is rotatably mounted between the housing 20 and the manipulation member 60 and inside the housing 20.

Figure 3A:
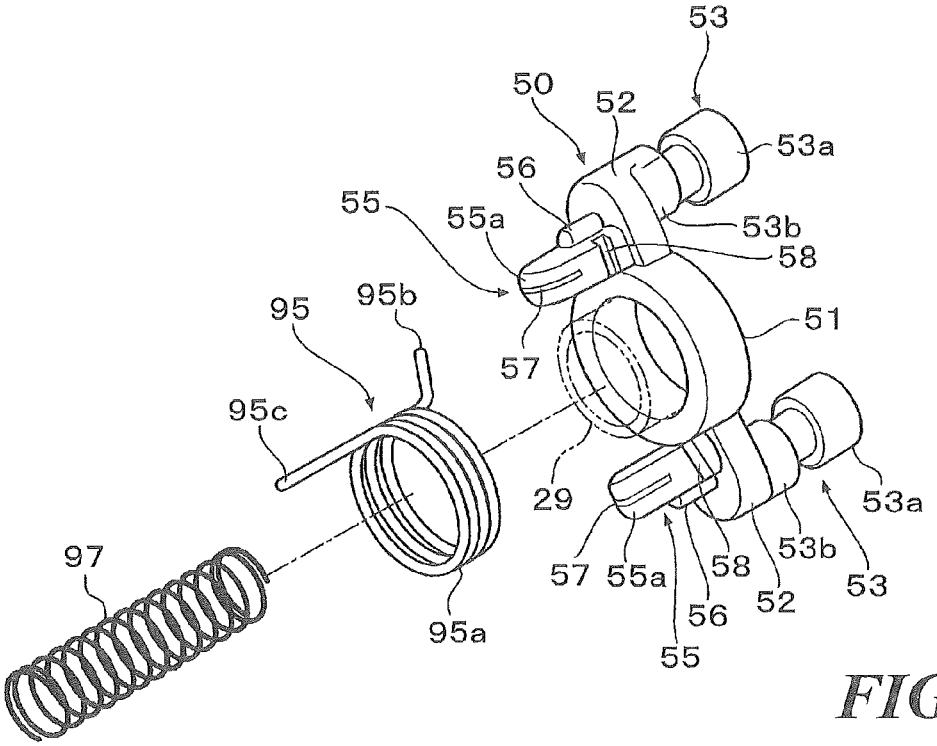
FIG. 3A is a perspective view of the rotary member.

As shown in FIG. 3A, the torsion spring 95 includes a coil portion 95*a*, a one end portion 95*b* extending from one end of the coil portion 95*a*, and an other end portion 95*c* extending from the other end of the coil portion 95*a*, which functions as the "spring" in the present invention.

The pair of link rods 90 and 91 have a square bar shape extending in a given length. The link rod 91 is longer than the link rod 90 in the present embodiment. The link rods 90 and 91 include hook portions 92 having a tapered outer surface at the distal ends while including fitting recess portions 93 having a recess shape at the base ends. A key lock bearing portion 94 is provided to the link rod 91 at a given position.

Figure 2A:
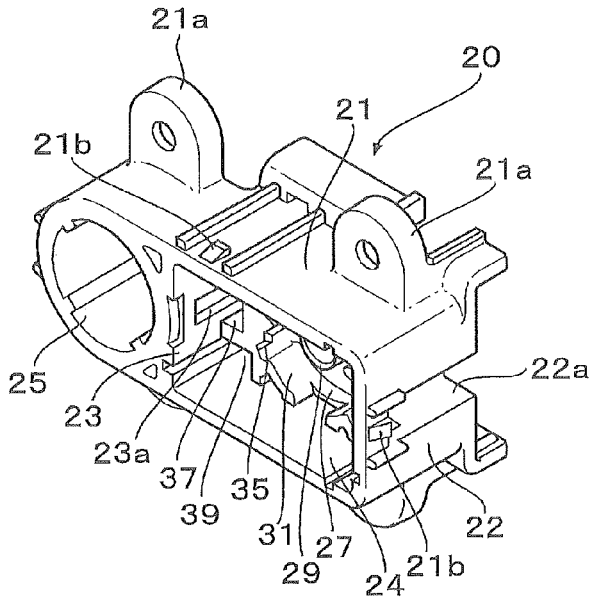
FIG. 2A is a perspective view of the housing.
Figure 2B:
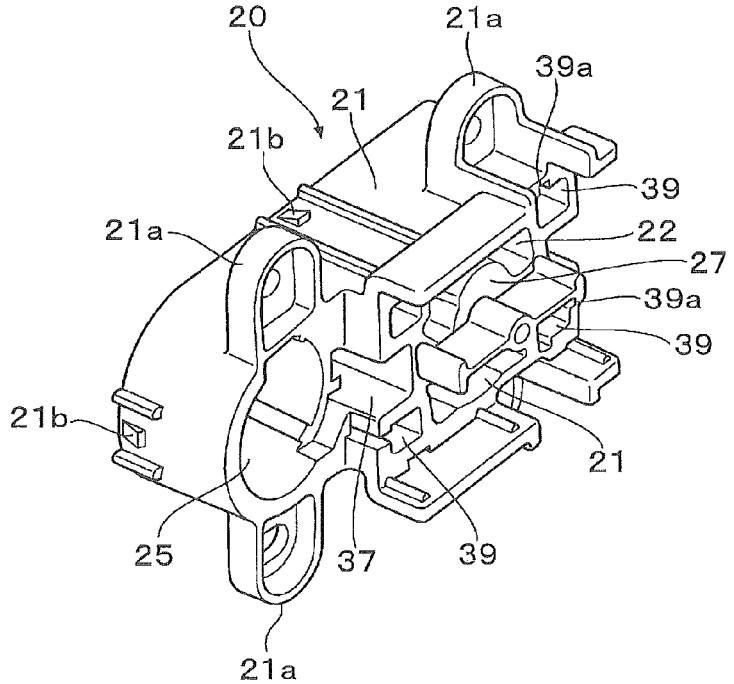
FIG. 2B is a perspective view of the housing seen from a different direction from FIG. 2A.
Figure 5:
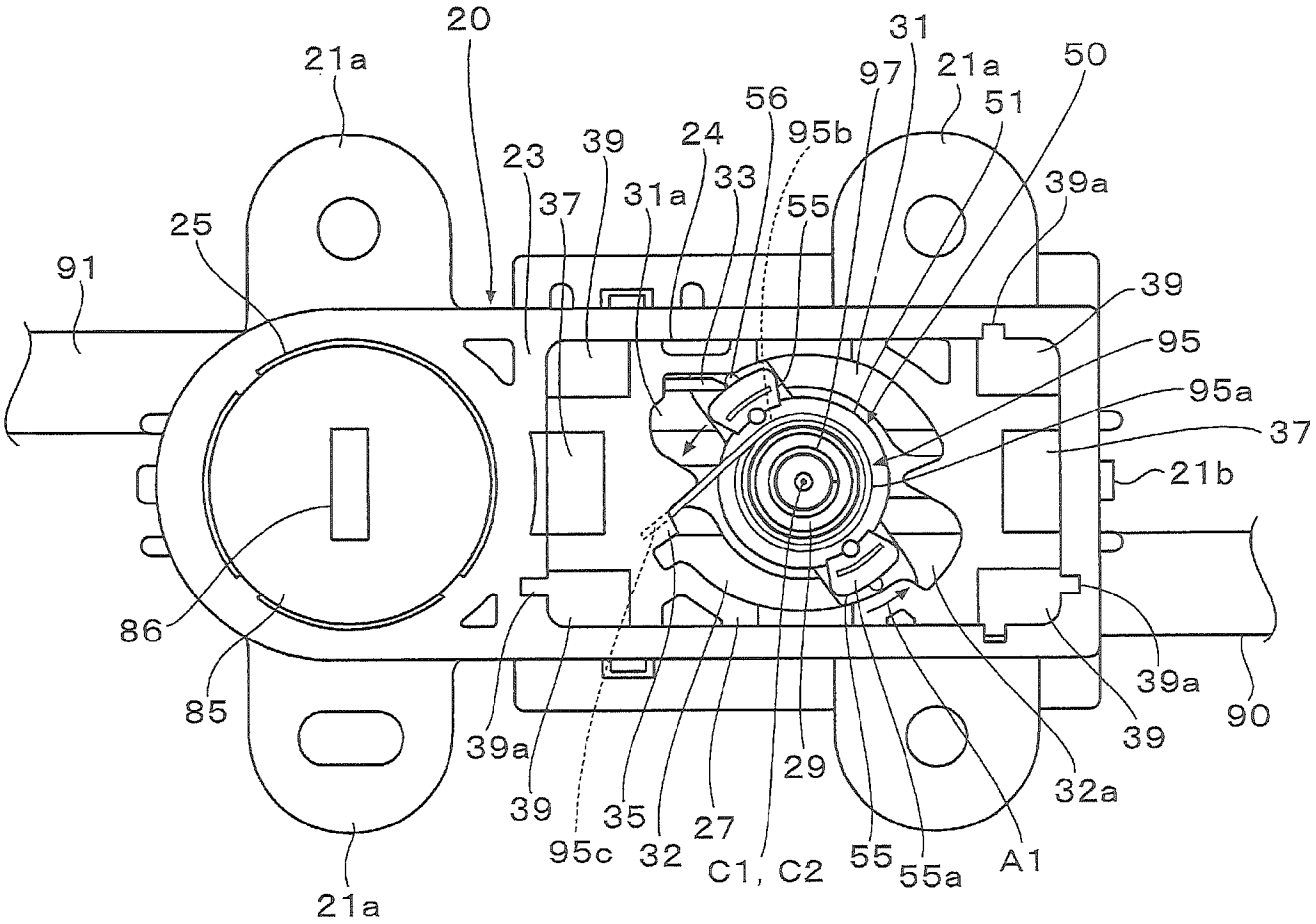
FIG. 5 An enlarged front view of relevant components of the locking device in a state where the manipulation member is removed.
Figure 6:
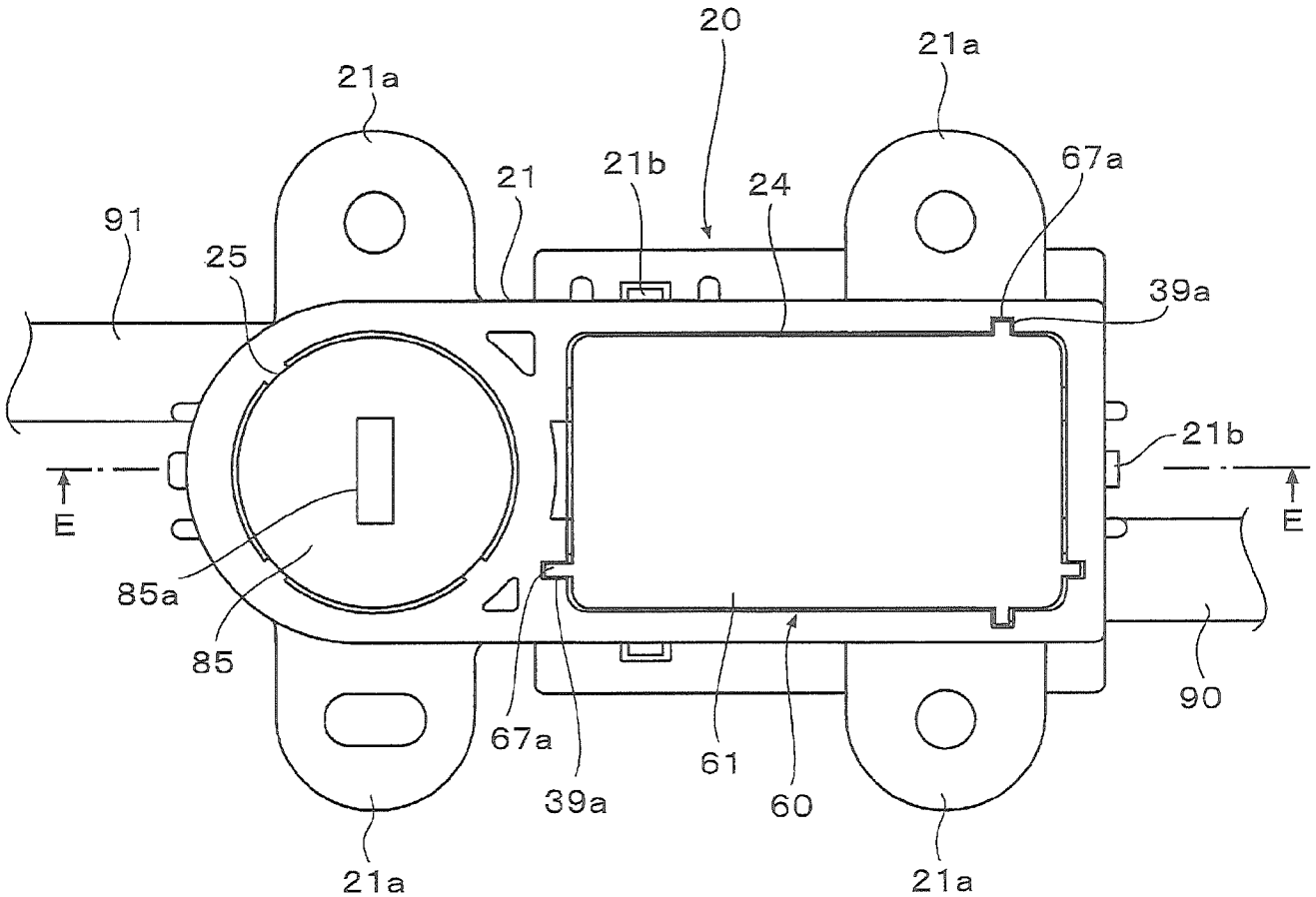
FIG. 6 An enlarged front view of relevant components of the locking device.

As shown in FIGS. 2A and 2B and FIG. 5, the housing 20 has a horizontally long box shape as a whole so as to conform to the mounting hole 6*a* of the lid 5. The housing 20 has an interior surrounded by a peripheral wall 21, being partitioned by a partition wall 23, by which a pit portion 24 having a square frame shape and a cylinder mounting portion 25 having a cylinder shape are provided. In the pit portion 24, the rotary member 50, the manipulation member 60, and the like are disposed. In the cylinder mounting portion 25, a key cylinder 85 is disposed.

A shaft portion 29 having a circular cylindrical shape protrudes toward the front-surface opening side from the center in a bottom portion 27 which is formed on the dorsal side (back surface side) of the pit portion 24. The shaft portion 29 is arranged to rotatably support the rotary member 50 while receiving and supporting one end portion of the coil spring 97 (see FIG. 3A, FIG. 5 and FIG. 12). The coil portion 95*a* of the torsion spring 95 is disposed on the outer circumference of a distal end of the shaft portion 29 (see FIG. 3A and FIG. 12).

Pin movement holes 31 and 32 are provided on the outer circumference of the shaft portion 29 protruding from the bottom portion 27. The pin movement holes 31 and 32 extend in an arc shape along the rotation direction of the rotary member 50. The pin movement holes 31 and 32 are provided at opposite positions in a circumferential direction with a shaft center C1 of the shaft portion 29 as a center (see FIG. 5). One end portions 31*a* and 32*a* in the circumferential direction of the respective pin movement holes 31 and 32, which are rotationally symmetrical around the shaft center C1 of the shaft portion 29, are diametrically enlarged than the other portions.

As shown in FIG. 5, a tongue-shaped return-restriction piece 33 is provided to the one end portion 31*a* in the circumferential direction of the pin movement hole 31 so as to extend from the inner peripheral surface on the side of the partition wall 23 toward the inner cavity of the pin movement hole 31. A step-like spring locking portion 35, to which the other end portion 95*c* of the torsion spring 95 locks, is provided to the pin movement hole 32 on the inner periphery on the side of the partition wall 23 (see FIG. 2A and FIG. 5).

As shown in FIG. 5, slide holes 37 and 37 are provided on both the sides of the pit portion 24 in the width direction so as to be aligned with the shaft portion 29. Guide holes 39 are provided to the four corners of the pit portion 24, and guide grooves 39*a* are provided to some of the guide holes 39. As shown in FIG. 2A, slits 22*a* and 23*a* are respectively provided to one side portion 22 and the partition wall 23 of the peripheral wall 21 of the housing 20 so as to communicate with the slide holes 37 and 37.

As shown in FIGS. 2A and 2B, plural mounting pieces 21*a* extend outward from the outer circumference of the peripheral wall 21 of the housing 20. The housing 20 is mounted to the lid 5 via these mounting pieces 21*a*. Plural engaging hooks 21*b* protrude from the outer circumference of the peripheral wall 21, for mounting the bezel 80.

As shown in FIG. 1, the bezel 80 mounted on the front surface side of the housing 20 has a horizontally long plate shape. The bezel includes a cylinder mounting hole 82, a manipulation member mounting hole 81, and plural engaging pieces 83 provided on the outer circumference. The bezel 80 is mounted on the front surface side of the housing 20 by engaging the engaging pieces 83 with the engaging hooks 21*b* of the housing 20.

Figure 11:
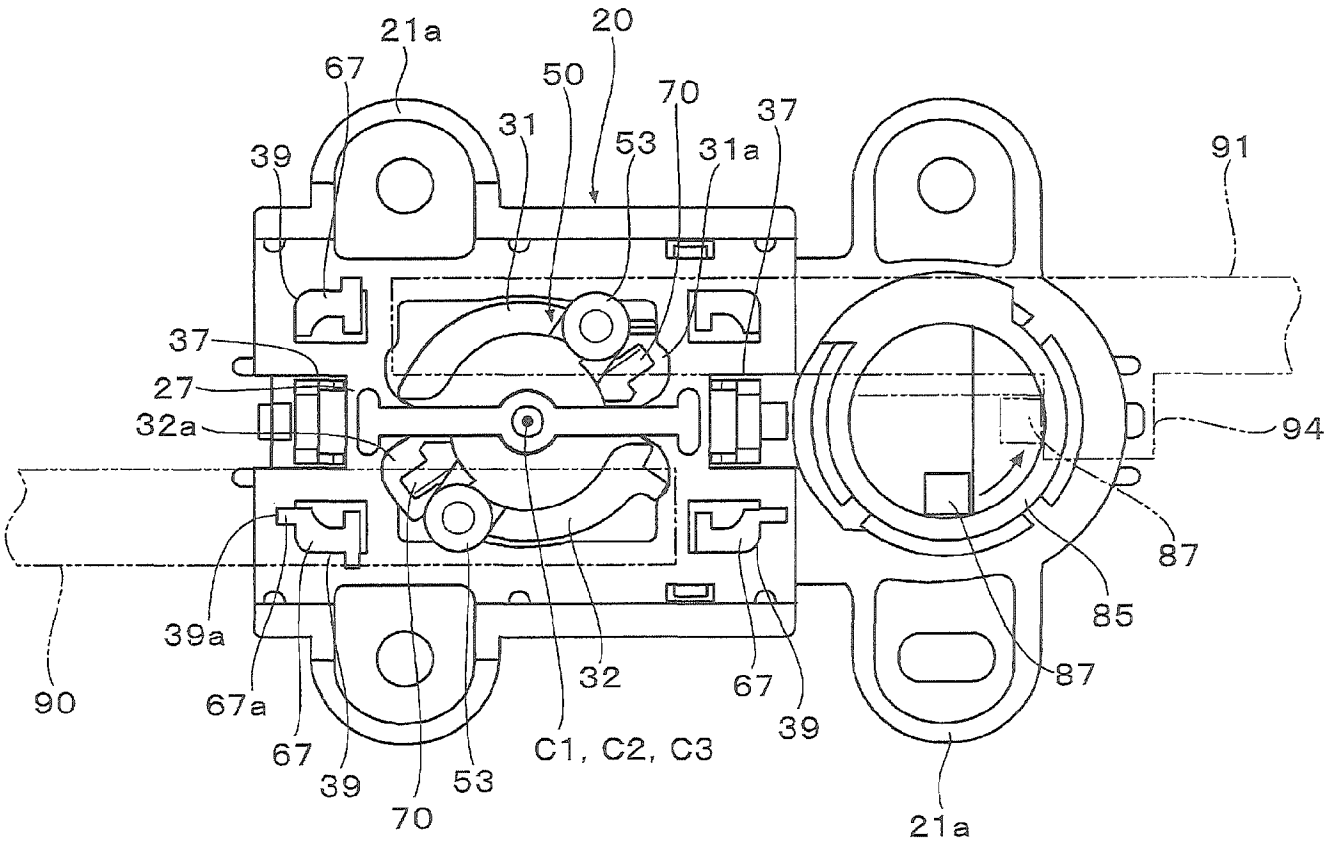
FIG. 11 An enlarged back view of relevant components of the locking device.
Figure 12:
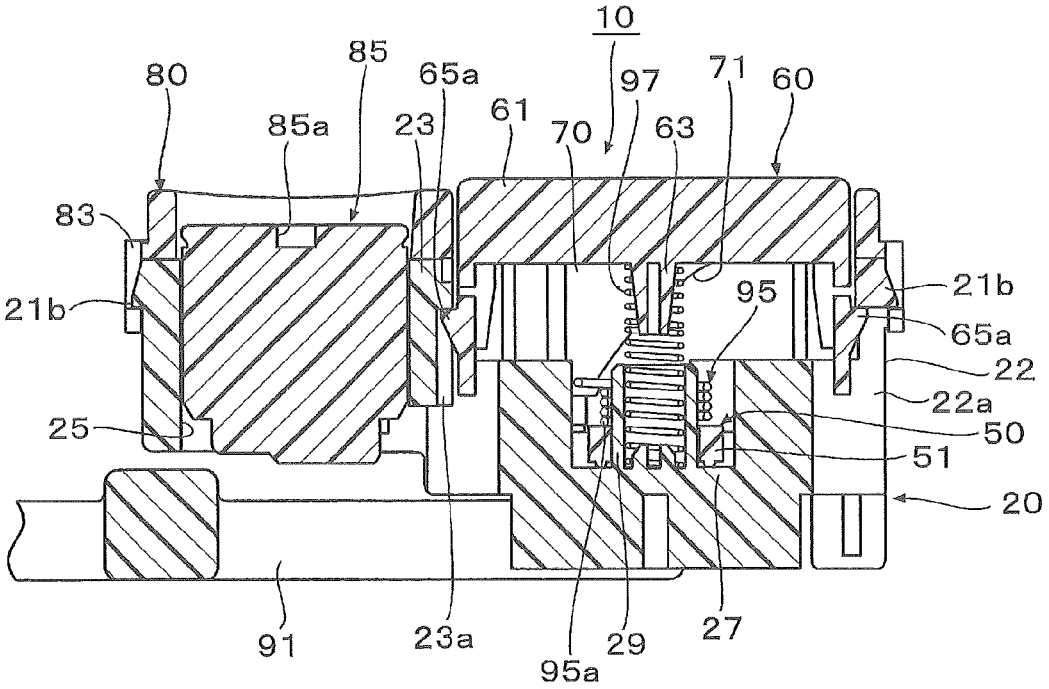
FIG. 12 A cross-sectional view taken along the line E-E of FIG. 6.

As shown in FIG. 5 and FIG. 11, the key cylinder 85 is disposed at the cylinder mounting portion 25 of the housing 20. By inserting a key (not illustrated) into a key hole 85*a* of the key cylinder 85 to rotate, a key lock protrusion 87 protruding from the back surface of the key cylinder 85 rotationally moves to a position matching the key lock bearing portion 94 of the link rod 91 to prevent the link rod 91 from being pulled in (see FIG. 11).

Figure 3B:
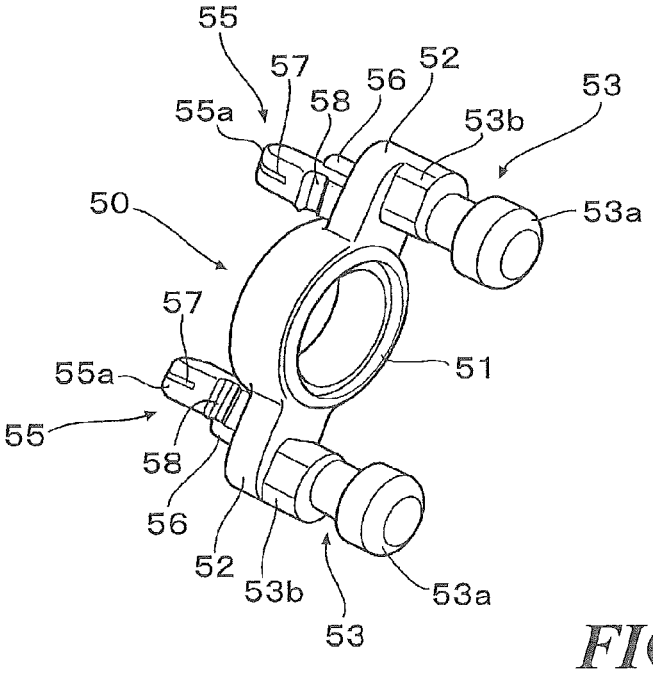
FIG. 3B is a perspective view of the rotary member seen from a different direction from FIG. 3A.

Next, a description of the rotary member 50 rotatably mounted to the above-described housing 20 will be provided with reference to FIGS. 3A and 3B and FIG. 5.

The rotary member 50 includes a rotary body 51 having a circular cylindrical shape. By inserting the shaft portion 29 of the housing 20 into the rotary body 51, the rotary member 50 is rotatably supported by the housing 20. A rotation center C2 of the rotary member 50 coincides with the shaft center C1 of the shaft portion 29 (see FIG. 5).

Extending portions 52 and 52 extend from opposite positions on the outer circumference of the rotary body 51 toward the outside diameter side. Pins 53 and 53 are formed on one end faces of the extending portions 52. The pins 53 and 53 are arranged at symmetrical positions with respect to the rotation center C2 of the rotary member 50. The pins 53 and 53 protrude in parallel with the rotation axis of the rotary member 50. In other words, the pins 53 and 53 protrude in the rotation axis direction of the rotary member 50. The rotation axis direction of the rotary member 50 corresponds to a center of rotation of the rotary member 50 (hereinafter, referred to simply as the "rotation axis direction of the rotary member 50"). In the pins 53, distal end portions 53*a* and base end portions 53*b* are larger in diameter than the middle portions. The distal end portions 53*a* detachably fit into the fitting recess portions 93 at the base ends of the link rods 90 and 91 while the base end portions 53*b* are disposed in the pin movement holes 31 and 32 of the housing 20. The distal end portions 53*a* and the base end portions 53*b* are provided to suppress rattling during rotation of the rotary member 50. Thus, the rotary member 50 is allowed to smoothly rotate.

Cam protrusions 55 and 55 are formed on the other end faces of the extending portions 52. The cam protrusions 55 and 55 are arranged at symmetrical positions with respect to the rotation center C2 of the rotary member 50, and protrude toward the front surface side along the rotation axis direction of the rotary member 50. To be specific, the rotary member 50 according to the present embodiment includes the two cam protrusions 55 and 55 at regular intervals in the circumferential direction about the rotation center C2. While the number of the cam protrusions 55 is not limited specifically, and it may be one, it is preferable to provide two or more cam protrusions 55 at regular intervals in the circumferential direction about the rotation center C2. The cam protrusions 55 function as the "cam contact portion" in the present invention.

The distal end face 55*a* of each cam protrusion 55 has an arc shape, and a grease groove 57 to store grease is formed on the outer circumference of the distal end portion including the distal end face 55*a*. Return-restriction protrusions 56 protrude from the outer surfaces at the base ends of the cam protrusions 55. The return-restriction protrusions 56 restrict the pins 53 and 53 from returning to the one end portions 31*a* and 32*a* of the respective pin movement holes 31 and 32 by engaging the return-restriction piece 33 of the housing 20 (see FIG. 5). At the base ends of the cam protrusion 55, spring locking grooves 58 and 58 to which the one end portion 95*b* of the torsion spring 95 locks are provided on both the sides of the return-restriction protrusions 56.

In a state where the shaft portion 29 of the housing 20 appears from the opening distal end of the rotary body 51, the torsion spring 95 is mounted by disposing the coil portion 95*a* so as to abut on the circumference on one end face of the rotary body 51 and on the outer circumference of the distal end of the shaft portion 29 (see FIG. 3A), and by making the one end portion 95*b* lock to the given spring locking groove 58 of the cam protrusion 55 while making the other end portion 95*c* lock to the spring locking portion 35 of the housing 20 (see FIG. 5). The rotary member 50 is biased to be rotated by the torsion spring 95 in a given direction: the direction indicated with the arrow A1 in FIG. 5A in this embodiment.

Figure 9A:
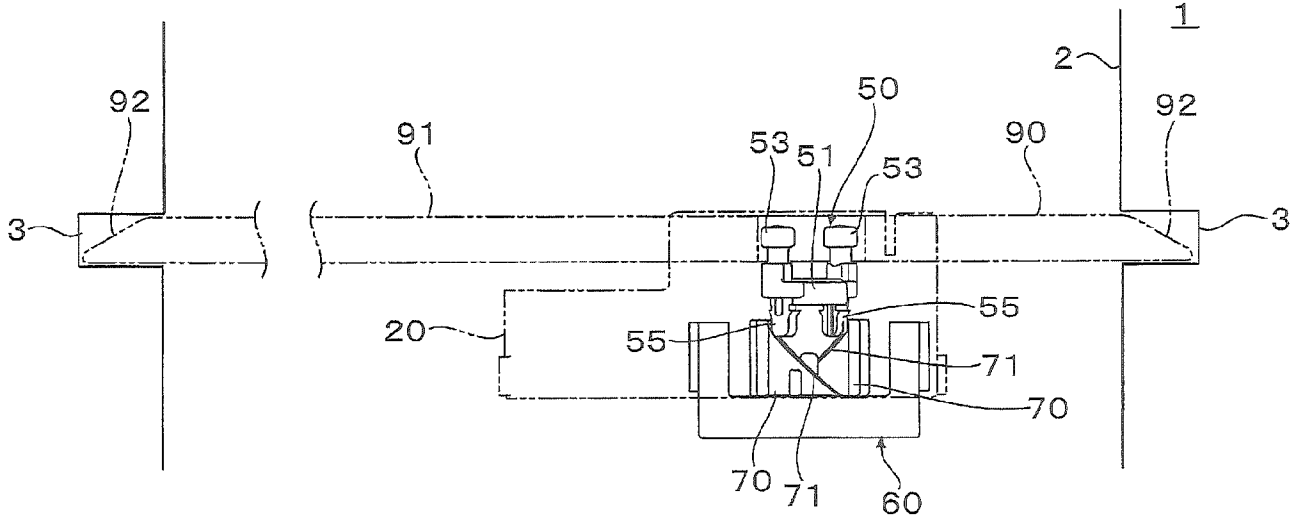
FIG. 9A is a plan view thereof.
Figure 9B:
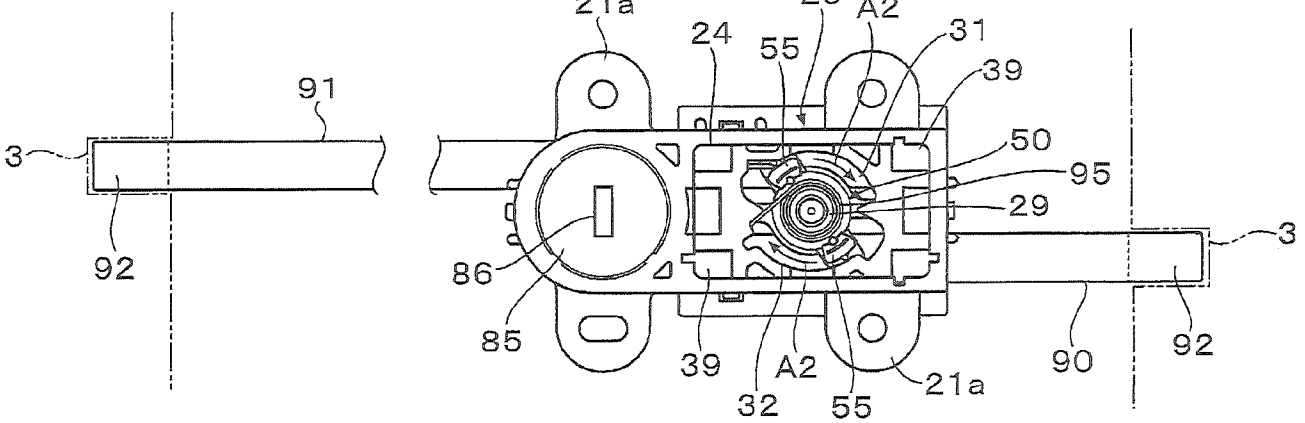
FIG. 9B is a front view thereof.

Fitting the distal end portions 53*a* and 53*a* of the pins 53 of the rotary member 50 into the fitting recess portions 93 and 93 at the base ends of the link rods 90 and 91 allows the base ends of the pair of link rods 90 and 91 to be pivotally mounted to the rotary member 50 at opposite positions on the outer circumference of the rotary member 50 (see FIG. 9B, FIG. 10B and FIG. 11). In the pair of link rods 90 and 91, the hook portions 92 and 92 are biased via the rotary member 50 biased to be rotated in the arrow A1 direction shown in FIG. 5 so as to move away from each other in the directions of engaging the locking portions 3 and 3 of the glove box 1.

While the link rods 90 and 91 are indirectly biased to slide by biasing to rotate the rotary member 50 with the use of the torsion spring 95 in the present embodiment, the present invention is not limited to this configuration. For example, a configuration such that one or both of the link rods 90 and 91 are directly biased to slide in the directions that the hook portions 92 engage the locking portions 3 with the use of a tension spring, a coil spring, or the like, or a configuration such that the rotary member 50 is biased to be rotated with the use of a tension spring, a coil spring, or the like is possible. In such a case, the tension spring, the coil spring, or the like functions as the "spring" in the present invention.

Next, a description of the manipulation member 60 pushably mounted to the above-described housing 20 will be provided with reference to FIGS. 4A and 4B, FIG. 7 and FIG. 8.

The manipulation member 60 includes a pressing portion 61 having a horizontally long plate shape so as to conform to the pit portion 24 of the housing 20. A protrusion 63 for spring supporting arranged to support the other end of the coil spring 97 protrudes from the center on the back side of the pressing portion 61.

Locking pieces 65 and 65 extend from center portions on both the sides in the width direction of the back side of the pressing portion 61. Each locking piece 65 includes a locking hook 65*a* provided flexible via a U-shaped slit. The manipulation member 60 is retained in and held by the housing 20 by slidably inserting the locking pieces 65 and 65 into the slide holes 37 and 37 of the housing 20, and locking the locking hooks 65*a* of the locking pieces 65 and 65 to one end of the slit 22*a* of the one side portion 22 of the housing 20 and one end of the slit 23*a* of the partition wall 23 (see FIG. 12).

Guide pieces 67 extend from the four corners on the back side of the pressing portion 61. Guide ribs 67*a* extending in the shaft direction protrude from the outer peripheries of some given guide pieces 67. The guide pieces 67 are inserted into the guide holes 39 of the housing 20 while the guide ribs 67*a* enter into the guide grooves 39*a* of the guide holes 39, and thereby the sliding movement of the manipulation member 60 is guided (see FIG. 6 and FIG. 8).

In the present embodiment, a pair of wall portions 70 and 70 including cam inclined surfaces 71 brought into contact with the cam protrusions 55 of the rotary member 50 erect from the back side of the pressing portion 61 along a direction such that the manipulation member 60 is pushed into the housing 20.

Figure 8:
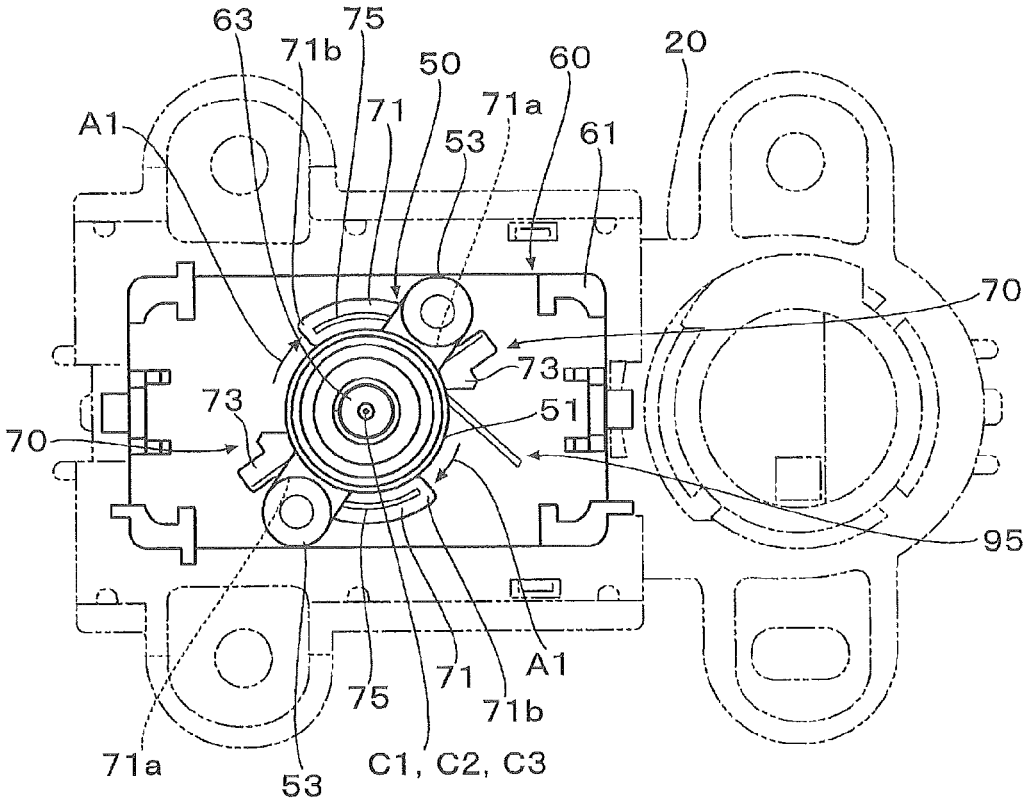
FIG. 8 An enlarged back view of the locking device showing the rotary member and the manipulation member.

As shown in FIG. 8, the pair of wall portions 70 and 70 according to the present embodiment are disposed at regular intervals in the circumferential direction around the rotation center C2 of the rotary member 50 with having an arc shape along the rotation direction of the cam protrusions 55 and 55 when seen in the rotation axis direction of the rotary member 50. To be specific, a center C3 of the pair of arc-shaped wall portions 70 and 70 coincides with the rotation center C2 of the rotary member 50 and the shaft center C1 of the shaft portion 29 of the housing 20 (see FIG. 8 and FIG. 11).

Figure 4A:
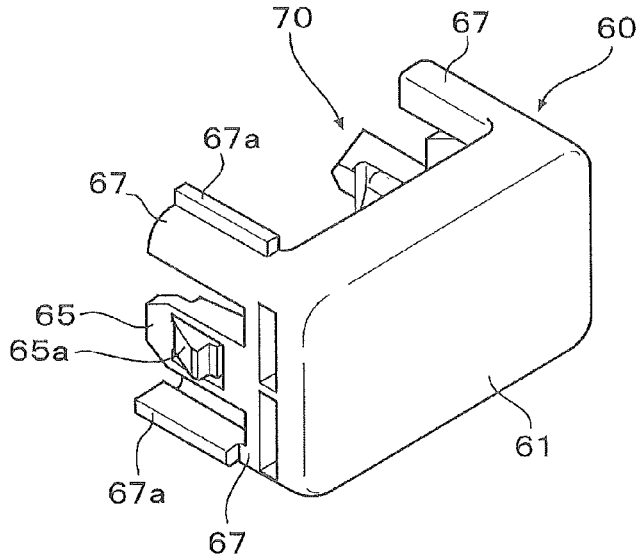
FIG. 4A is a perspective view of the manipulation member.
Figure 4B:
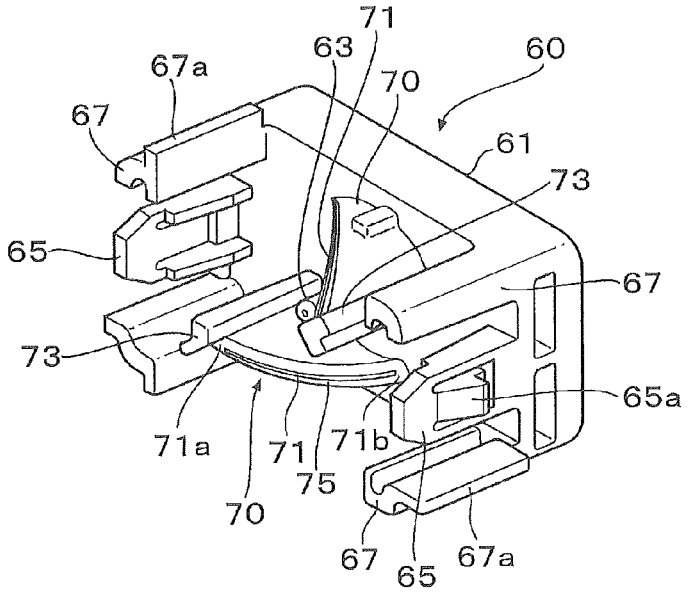
FIG. 4B is a perspective view of the manipulation member seen from a different direction from FIG. 4A.
Figure 7:
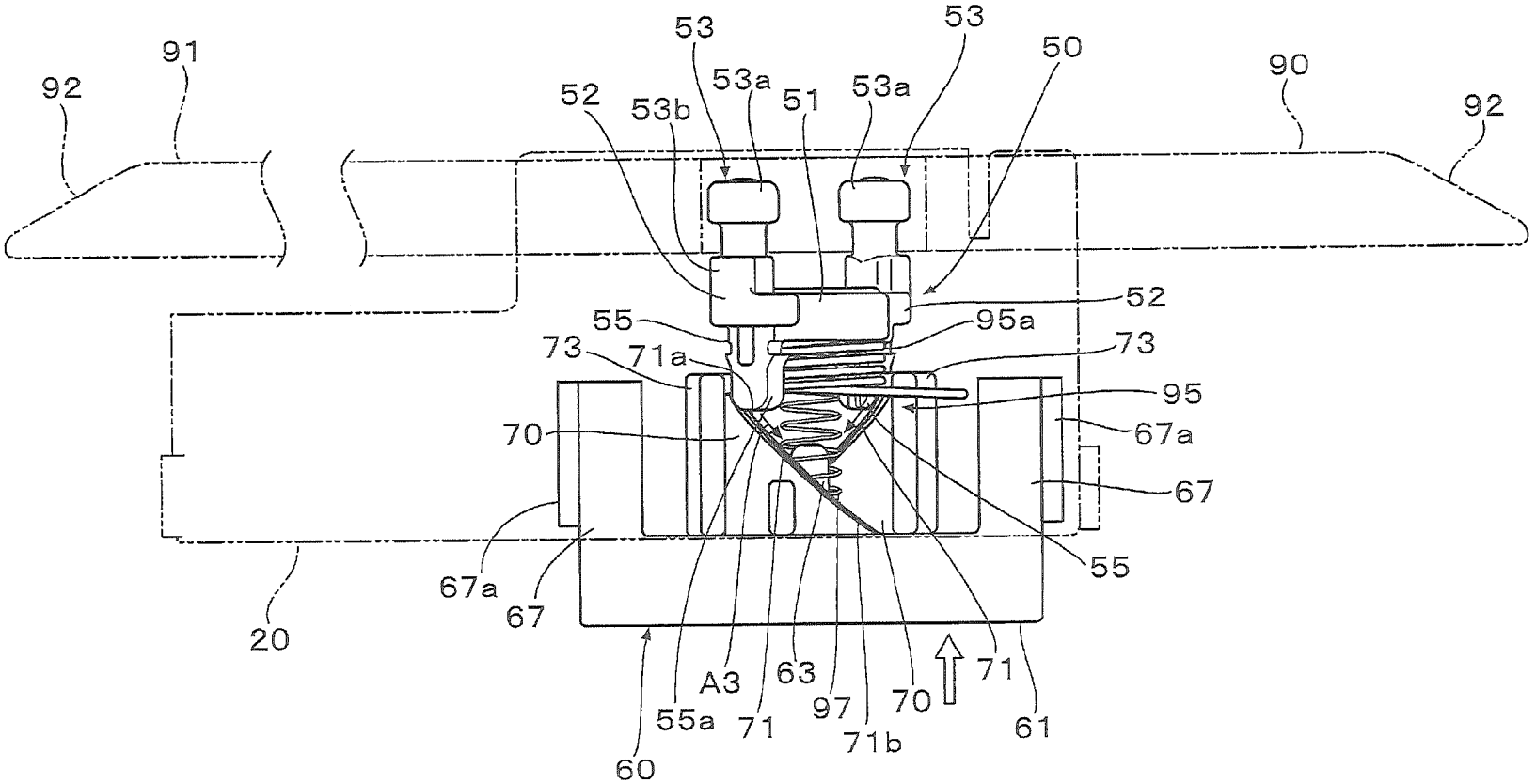
FIG. 7 An enlarged plan view of relevant components of the locking device.

As shown in FIG. 4B and FIG. 7, the pair of wall portions 70 and 70 include cam inclined surfaces 71 and 71 that are arranged to be brought into contact with the cam protrusions 55 and 55 of the rotary member 50 to convert a pushing force of the manipulation member 60 into a rotational force of the rotary member 50. To be specific, each arc-shaped wall portion 70 has an end face that is cut so as to gradually become lower in height along the circumferential direction and to be oblique along the circumferential direction, which turns out forming the cam inclined surfaces 71.

As shown in FIG. 4B and FIG. 8, in the pair of wall portions 70 and 70, one end portions 71*a* and 71*a* in the circumferential direction that protrude highest in the cam inclined surfaces 71, and the other end portions 71*b* and 71*b* in the circumferential direction that are lowest in the cam inclined surfaces 71 are disposed symmetrically with respect to the center C3 of the manipulation member 60.

Column portions 73 are provided connected to the wall portions 70 on the outer peripheries on the sides of the one end portions 71*a* of the cam inclined surfaces 71. The upper end portions of the column portions 73 have the shape of protruding higher than the one end portions 71*a* that are highest in the cam inclined surfaces 71. The column portions 73 are in contact with the cam protrusions 55 and 55 in a state where the manipulation member 60 is not pushed into the housing 20, and function to limit the rotation of the rotary member 50 (see FIG. 7). As shown in FIG. 4B and FIG. 8, grease grooves 75 to store grease are provided on the cam inclined surfaces 71 in the ranges from the one end portions 71*a* to the other end portions 71*b* in the circumferential direction.

The manipulation member 60 is mounted to the housing 20 via the coil spring 97 so as to be pushable into the housing 20. At this time, the one end portion of the coil spring 97 is inserted into and supported by the inner circumference of the shaft portion 29 of the housing 20 while the other end portion is supported by the protrusion 63 for spring supporting of the manipulation member 60, and in general, the coil spring 97 biases the manipulation member 60 in the direction away from the front surface of the housing 20 (see FIG. 7 and FIG. 12). At this time, the manipulation member 60 is retained while locking hooks 65*a* of the locking pieces 65 and 65 lock to the slits 22*a* and 23*a* of the housing 20 as described above.

In the above-described state, the manipulation member 60 is held at a position such that the arc-shaped distal end faces 55*a* and 55*a* of the cam protrusions 55 and 55 of the rotary member 50 are in contact with the one end portions 71*a* and 71*a* in the circumferential direction of the cam inclined surfaces 71 and 71 of the wall portions 70 and 70 of the manipulation member 60 (see FIG. 7 and FIGS. 9A and 9B).

When the manipulation member 60 is pushed into the housing 20 against the biasing force of the coil spring 97 from the above-described state, the cam protrusions 55 and 55 are pressed by the cam inclined surfaces 71 and 71 of the wall portions 70 and 70 to move from the one end portions 71*a* of the cam inclined surfaces 71 toward the other end portions 71*b* to rotate the rotary member 50 in the arrow A2 direction (see FIG. 9B) against the rotational biasing force of the torsion spring 95. Thus, the hook portions 92 and 92 of the pair of link rods 90 and 91 slide to the positions of not engaging the locking portions 3 and 3 of the glove box 1 (see FIGS. 10A and 10B).

The pair of arc-shaped wall portions 70 and 70 are provided so as to correspond to the cam protrusions 55 and 55 of the rotary member 50 in the present embodiment; however, any number of arc-shaped wall portions 70 can be provided so as to correspond to the number of the cam protrusions 55. A wall portion having a circular cylindrical shape when seen from the rotation axis direction of the rotary member 50 may be provided, and a given number of cam inclined surfaces 71 may be provided on the end face of the wall portion. Wall portions may be provided in a concentric fashion, and cam inclined surfaces may be provided on the end faces of the wall portions.

Next, a description of operation and effect of the locking device 10 including the above-described constructional members will be provided.

For example, the locking device 10 is assembled as follows. To be specific, the pins 53 and 53 of the rotary member 50 are inserted into the one end portions 31*a* and 32*a* in the circumferential direction of the pin movement holes 31 and 32 of the housing 20 while the shaft portion 29 of the housing 20 is inserted into the rotary body 51. Then, the rotary member 50 is rotated via the shaft portion 29 until the return-restriction protrusion 56 of the rotary member 50 climbs over the return-restriction piece 33 of the housing 20. Thus, the rotary member 50 can be rotatably mounted to the shaft portion 29 of the housing 20 so that the pins 53 and 53 of the rotary member 50 do not return to come off the one end portions 31*a* and 32*a* in the circumferential direction of the pin movement holes 31 and 32 (see FIG. 5).

In a state where the shaft portion 29 appears from the rotary body 51, the torsion spring 95 is mounted by disposing the coil portion 95*a* of the torsion spring 95 on the outer circumference of the shaft portion 29, making the one end portion 95*b* lock to the given spring locking groove 58 of the cam protrusion 55, and making the other end portion 95*c* lock to the spring locking portion 35 of the housing 20 in this state.

Then, the locking pieces 65 and 65 and the guide pieces 67 of the manipulation member 60 are matched to the slide holes 37 and 37 and the guide holes 39 of the housing 20 in a state where the one end portion of the coil spring 97 is inserted into the inner circumference of the shaft portion 29 while the other end portion is supported by the protrusion 63 for spring supporting of the manipulation member 60, and the manipulation member 60 is pushed into the housing 20. As a result, the locking hooks 65*a* of the locking pieces 65 and 65 lock to the one ends of the slit 22*a* and 23*a* of the housing 20 in a state where the manipulation member 60 is biased by the coil spring 97 in the direction away from the front surface of the housing 20, and thus the manipulation member 60 is mounted to the housing 20 so as to be pushable into the housing 20 (see FIG. 12).

The engaging pieces 83 of the bezel 80 are made to engage the engaging hooks 21*b* of the housing 20 in this state, and thereby the bezel 80 is mounted to the housing 20. Then, the housing 20 is mounted to the mounting hole 6*a* of the lid 5 via the mounting pieces 21*a* while the distal end portions 53*a* and 53*a* of the pins 53 of the rotary member 50 are made to fit into the fitting recess portions 93 and 93 of the link rods 90 and 91. Thus, the pair of link rods 90 and 91 are pivotally mounted to the rotary member 50 at the opposite positions on the outer circumference of the rotary member 50, and the hook portions 92 and 92 are slidably supported by the rod in-and-out holes 7*a* of the lid 5. In this state, the rotary member 50 is biased to be rotated in the arrow A1 direction (see FIG. 5) by the torsion spring 95, and thereby the pair of link rods 90 and 91 are biased in the directions of engaging the locking portions 3 and 3 of the glove box 1 such that the hook portions 92 and 92 move away from each other (see FIG. 9A).

Then, when the lid 5 is pushed in to close the opening portion 2 of the glove box 1, the tapered surfaces of the hook portions 92 of the link rods 90 and 91 are pressed by the inner surfaces on both the sides of the opening portion 2, and the link rods 90 and 91 are pulled in inwardly of the lid against the rotational biasing force of the torsion spring 95. When the hook portions 92 reach the recess locking portions 3 and 3 of the opening portion 2, the rotary member 50 is biased to be rotated by the torsion spring 95 to push out again the link rods 90 and 91 outwardly of the lid, and the hook portions 92 and 92 engage the locking portions 3 and 3. Thus, the opening portion 2 of the glove box 1 can be locked in a closed state with the lid 5 (see FIGS. 9A and 9B).

At this time, the pair of link rods 90 and 91 slidably move in synchronization with the rotation of the rotary member 50 in response thereto in this locking device 10, so that so-called one-side engagement that only one hook portion 92 of either one of the pair of link rods 90 and 91 engages one of the locking portions 3 and 3 of the glove box 1 can be made less likely to occur. As a result, the opening portion 2 of the glove box 1 can be stably locked in a closed state with the lid 5.

Inserting a key (not illustrated) into the key hole 86 of the key cylinder 85 to rotate, and rotationally moving the key lock protrusion 87 protruding from the back side of the key cylinder 85 to the position matching the key lock bearing portion 94 of the link rod 91 in this state as indicated with the imaginary line in FIG. 11 can prevent the link rod 91 from being pulled in inwardly of the lid. Thus, the locked state of the opening portion 2 by the lid 5 can be maintained.

In opening the lid 5 from the opening portion 2 of the glove box 1, the manipulation member 60 is pushed into the housing 20 against the biasing force of the coil spring 97. Then, the cam protrusions 55 and 55 of the rotary member 50 are pressed by the cam inclined surfaces 71 and 71 of the wall portions 70 and 70 of the manipulation member 60, and move from the one end portions 71*a*, which are higher in the circumferential direction, to the other end portions 71*b*, which are lower, with sliding in contact on the cam inclined surfaces 71 as indicated with the arrows A3 in FIG. 7. The rotary member 50 rotates in the arrow A2 direction (see FIG. 9B) against the rotational biasing force of the torsion spring 95 via the shaft portion 29 of the housing 20 to slide the hook portions 92 and 92 of the pair of link rods 90 and 91 to the positions of not engaging the locking portions 3 and 3 of the glove box 1 (see FIGS. 10A and 100B). As a result, the lid 5 is moved from the opening portion 2 of the glove box 1, which allows the opening portion 2 to be opened.

Then, because the wall portions 70 including the cam inclined surfaces 71 are provided to one of the rotary member 50 and the manipulation member 60 in this locking device 10 (to the manipulation member 60 in the present embodiment), the cam inclined surfaces 71 can be made relatively longer compared with the case of the side lock device disclosed in Patent Document 2 where the tapered surface is provided to one end of the arc-shaped slit of the rotor. Thus, the slidable contact distance of the cam protrusions 55 on the cam inclined surfaces 71 can be secured long, so that pushing the manipulation member 60 into the housing 20 can smoothly rotate the rotary member 50 at a relatively large angle.

Because the pair of cam protrusions 55 and 55 are provided to the rotary member 50 at regular intervals in the circumferential direction about the rotation center C2 of the rotary member 50 and the pair of wall portions 70 and 70 are provided to the manipulation member 60 at regular intervals in the circumferential direction about the center C3 coinciding with the rotation center C2 of the rotary member 50 in the present embodiment, that is, at least two cam protrusions 55 and at least two wall portions 70 including the cam inclined surfaces 71 are provided at regular intervals in the circumferential direction about the rotation center C2 of the rotary member 50, the pushing force of the manipulation member 60 exerts the effect evenly in the circumferential direction of the rotary member 50, and can be smoothly converted into the rotational force of the rotary member 50.

Further in the present embodiment, because the wall portions 70 including the cam inclined surfaces 71 have an ark shape when seen in the rotation axis direction of the rotary member 50, the cam protrusions 55 can be moved along the shape of the wall portions 70, which can prevent the cam protrusions 55 from going off the cam inclined surfaces 71. Because the cam inclined surfaces 71 provided on the end faces of the arc-shaped wall portions 70 have the shape of gradually becoming lower in height along the circumferential direction, this relatively compact shape can maintain the contact state between the cam protrusions 55 and the cam inclined surfaces 71 even if the rotary member 50 is rotated.

The wall portions 70 including the cam inclined surfaces 71 are provided to the manipulation member 60 while the cam protrusions 55 are provided to the rotary member 50 in the present embodiment. Providing the cam protrusions 55 to the rotary member 50 like this allows the rotary member 50 to be easily reduced in weight and size. Thus, the housing 20 to which the rotary member 50 is mounted can be reduced in size while the rotary member 50 can be rotated smoothly.

Because the cam protrusions 55 include the arc-shaped distal end faces 55*a* arranged to be brought into contact with the cam inclined surfaces 71 of the wall portions 70 in the present embodiment, the contact areas of the cam protrusions 55 with the cam inclined surfaces 71 can be reduced so that slip can be improved to reduce friction resistance of the cam protrusions 55, which allows the pushing force of the manipulation member 60 to be smoothly converted into the rotational force of the rotary member 50. The shape of the cam protrusions 55 can be thinned, which can reduce the rotary member 50 in size.

Because the base ends of the pair of link rods 90 and 91 are pivotally mounted to the rotary member 50 at the opposite positions on the outer circumference of the rotary member 50 in the present embodiment, backlash between gears such as a rack and pinion is not produced. Thus, the pair of link rods 90 and 91 can be smoothly slid without rattling, and have a relatively simple configuration.

Because the rotary member 50 is rotatably mounted between the housing 20 and the manipulation member 60 and inside the housing 20 in the present embodiment, the rotary member 50 can be prevented from being exposed to the outside of the housing 20 and protected from external stress or the like.

Figure 13:
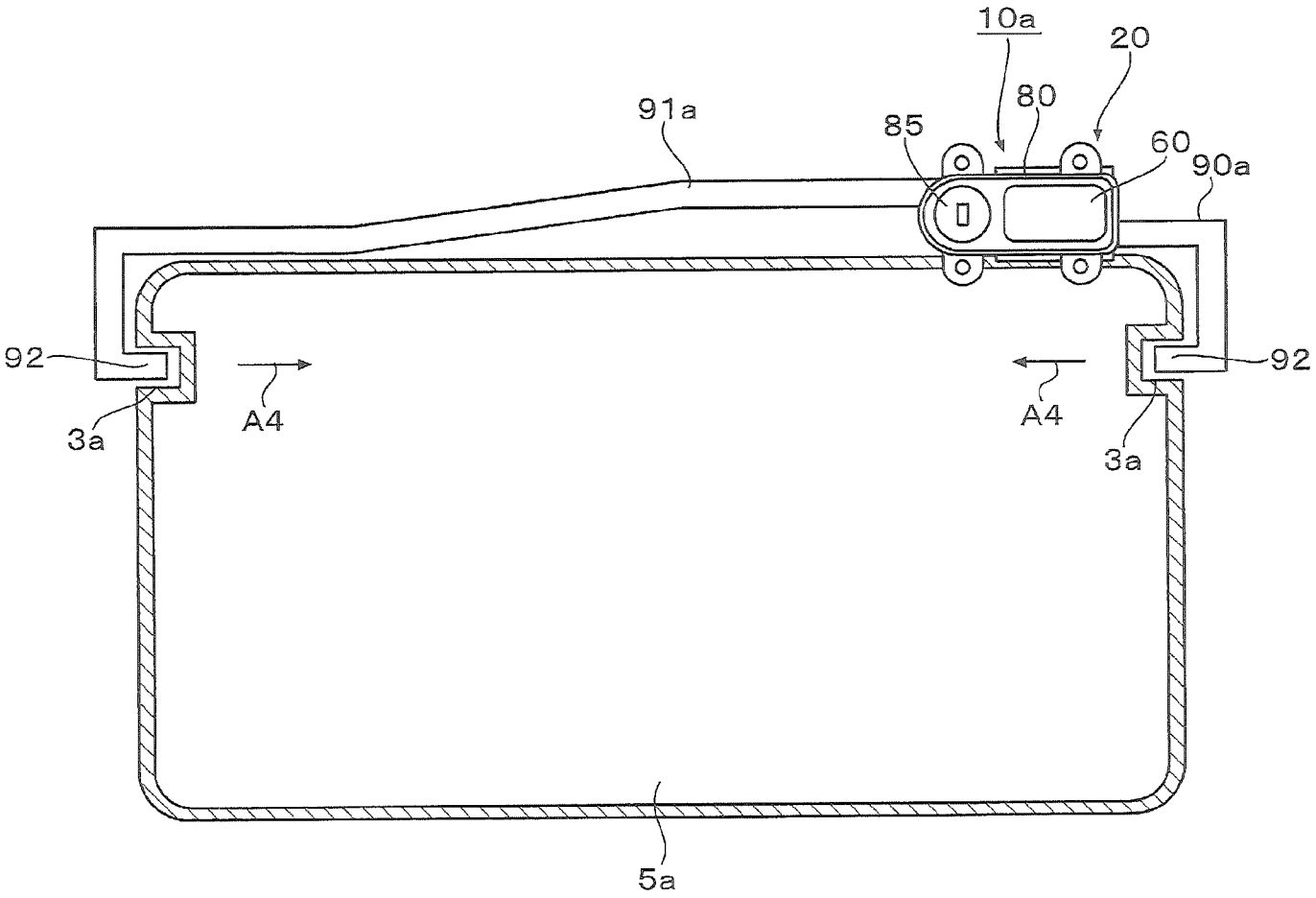
FIG. 13 An explanatory view of relevant components of a locking device for an openable/closable body according to the second embodiment of the present invention.

A locking device for an openable/closable body according to the second embodiment of the present invention is illustrated in FIG. 13. The same reference numerals are provided to the components that are substantially same as those in the above-described embodiment, and explanations of those components are omitted.

As shown in FIG. 13, a locking device 10*a* for an openable/closable body according to the present embodiment (hereinafter, referred to as the "locking device 10*a*") is different from the above-described embodiment in the positions where the locking portions are provided and the positions where the other members are disposed. To be specific, the locking device 10*a* has a configuration that recess locking portions 3*a* and 3*a* are provided to the lid 5, which functions as the "openable/closable body" in the present invention, on both the sides in the width direction while the housing 20 is mounted to the glove box, which functions as the "fixed body" in the present invention.

A pair of link rods 90*a* and 91*a* pivotally mounted to the rotary member 50 that is rotatably mounted to the housing 20 have shapes of being bent at given positions into the letter L, and the distal end portions of the link rods 90*a* and 91*a* are bent so as to be folded back toward the inside of the lid to form the hook portions 92 and 92. The pair of link rods 90*a* and 91*a* are biased via the rotary member 50 biased to be rotated by the torsion spring 95 in directions of engaging the locking portions 3*a* and 3*a* of a lid 5*a*, that is, directions such that the hook portions 92 and 92 approach each other (see the arrows A4).

When the manipulation member 60 is pushed into the housing 20 while the opening portion of the glove box is closed with the lid 5, the rotary member 50 is rotated against the rotational biasing force of the torsion spring 95 by the mutual effects of the cam protrusions 55 and the cam inclined surfaces 71 in a manner similar to the above-described embodiment, which slides the hook portions 92 and 92 of the pair of link rods 90*a* and 91*a* to the positions of not engaging the locking portions 3*a* and 3*a* of the glove box 1 to open the lid 5*a*.

A locking device for an openable/closable body according to the third embodiment of the present invention is illustrated in FIG. 14 to FIGS. 22A and 22B. The same reference numerals are provided to the components that are substantially same as those in the above-described embodiment, and explanations of those components are omitted.

Figure 14:
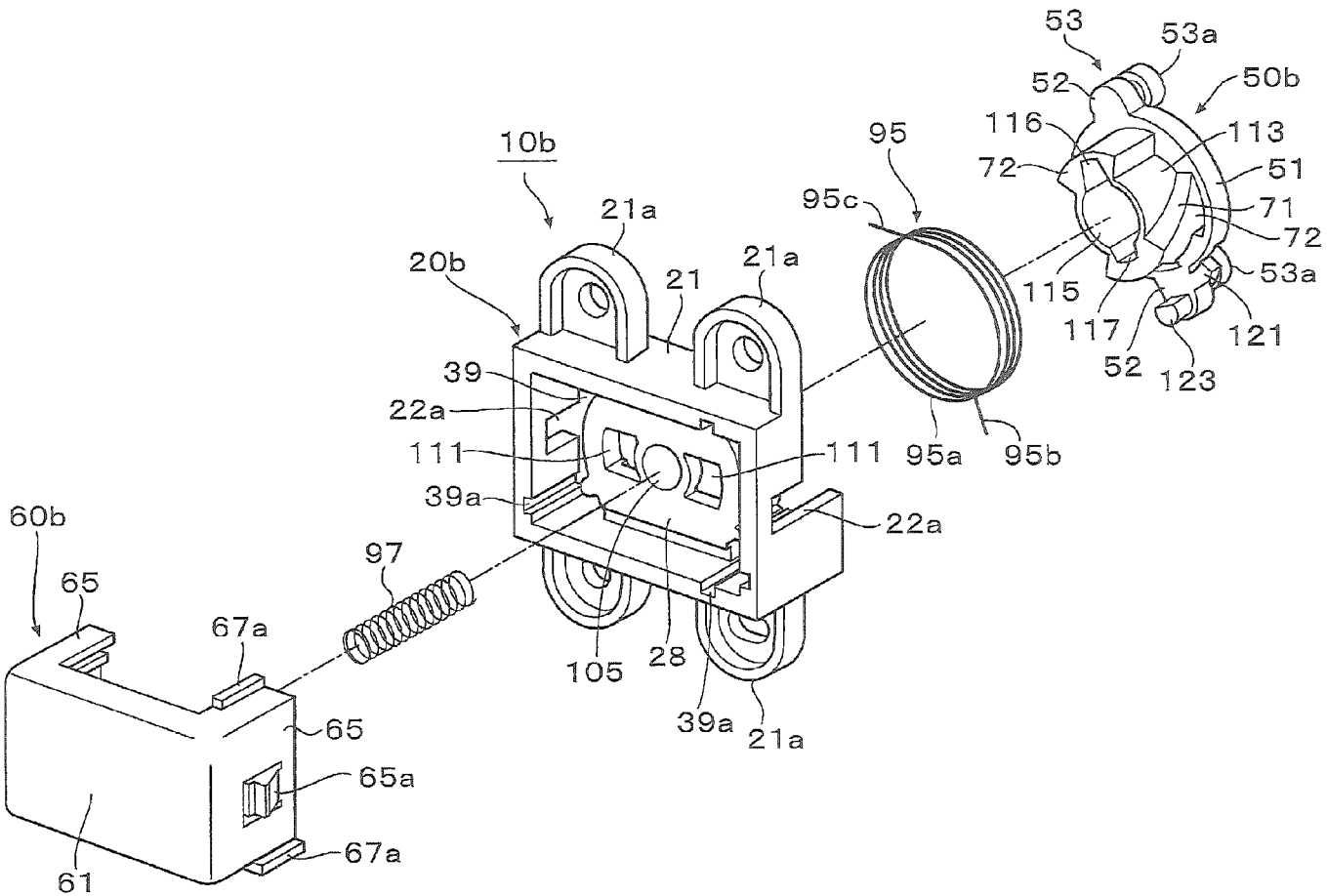
FIG. 14 An exploded perspective view of a locking device for an openable/closable body according to the third embodiment of the present invention.
Figure 15:
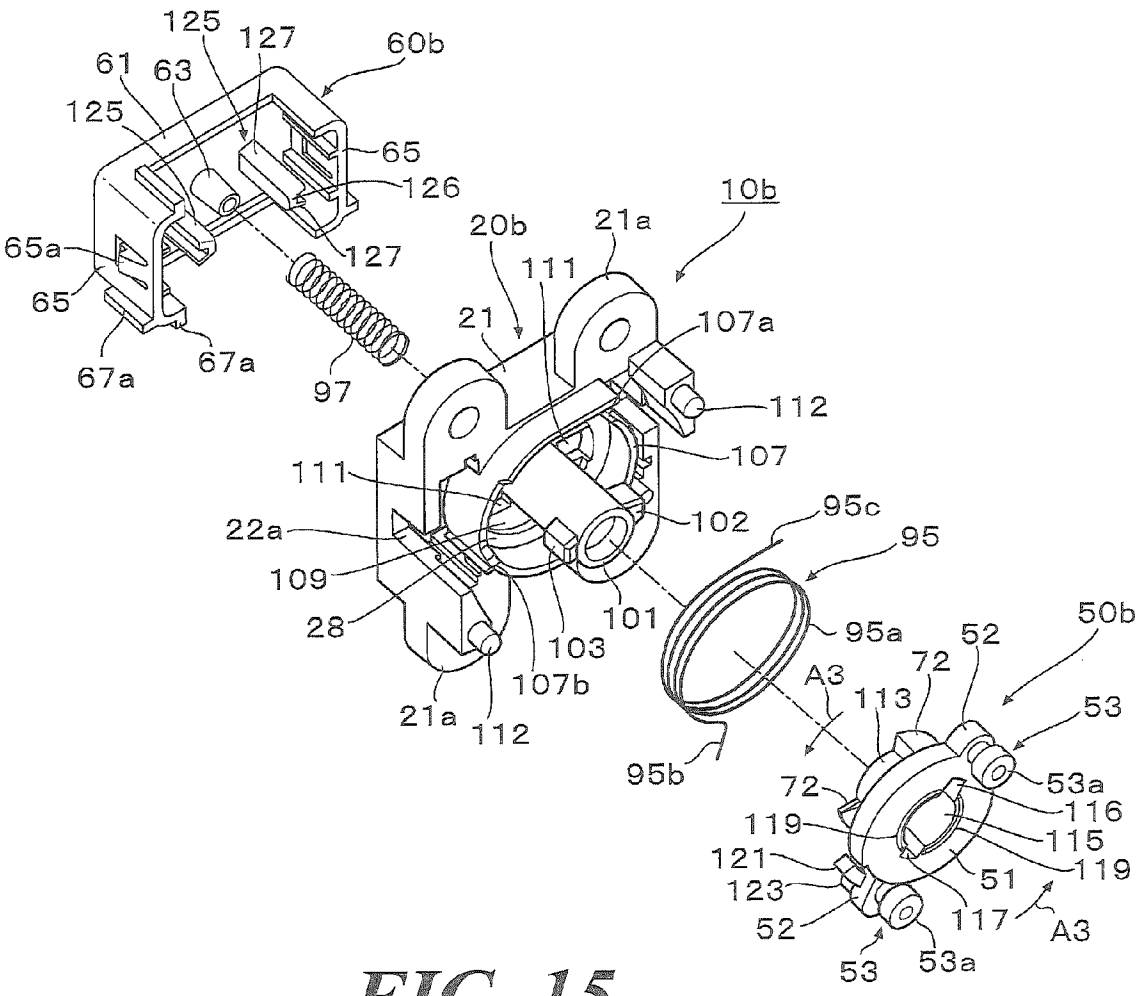
FIG. 15 An exploded perspective view of the locking device seen from a different direction from FIG. 14.
Figure 16:
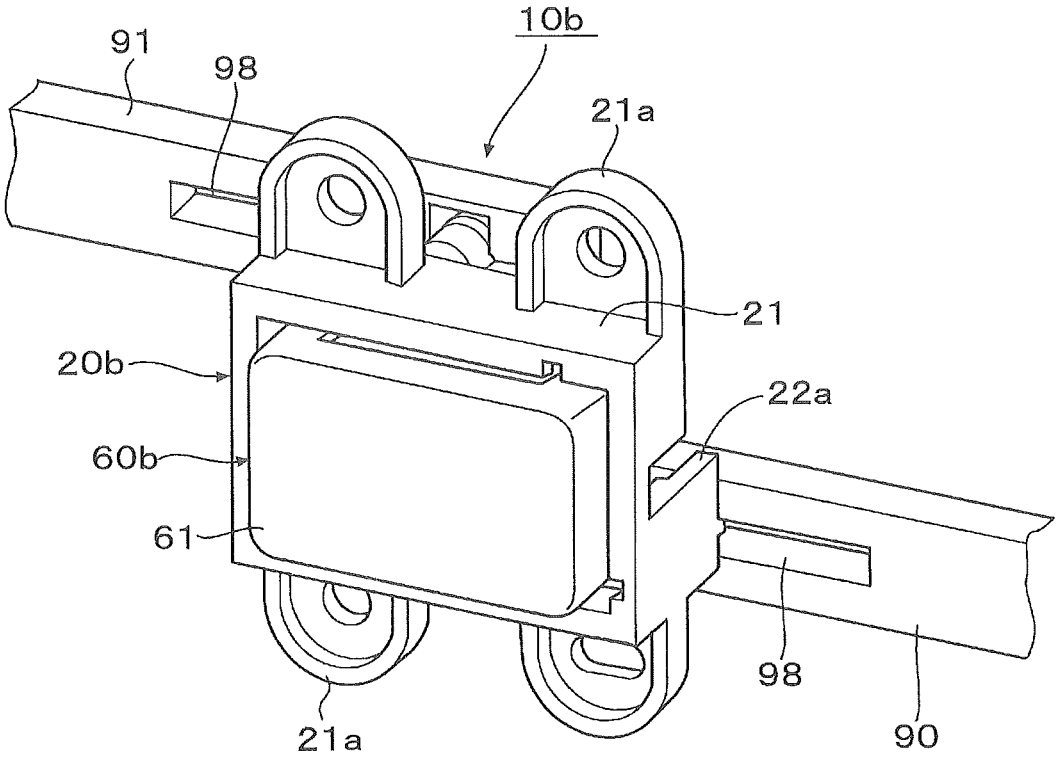
FIG. 16 A perspective view of the locking device.

As shown in FIG. 14 and FIG. 15, a locking device 10*b* for an openable/closable body according to the present embodiment (hereinafter, referred to as the "locking device 10*b*") is different from the above-described embodiment in the positions where the manipulation member and the rotary member are disposed and in the wall portions including the cam inclined surfaces and in a member where the cam contact portions are disposed.

To be specific, the locking device 10*b* has a configuration such that a manipulation member 60*b* is pushably mounted to a housing 20*b* on the front surface side while a rotary member 50*b* is pushably mounted to the housing 20*b* on the back surface side, and wall portions 72 including cam inclined surfaces 71 are provided to the rotary member 50*b* while the cam contact portions 125 are provided to the manipulation member 60*b*.

In the present invention, the "front surface of the housing" means the surface corresponding to the front side of the openable/closable body or the fixed body to which the housing is mounted, and the "back surface of the housing" means the surface corresponding to the back side of openable/closable body or the fixed body.

The housing 20*b* according to the present embodiment has a square frame shape including no portion for key cylinder disposition and includes the guide holes 39 and 39 on both the sides on the inner circumference, into which the locking pieces 65 and 65 of the manipulation member 60*b* are slidably inserted. A shaft portion 101 protrudes from the center on the back surface side of the bottom portion 28 of the housing 20*b*. Differently-shaped protrusions 102 and 103 protrude from the opposite positions on the outer circumference of the distal end portion of the shaft portion 101 toward the outside diameter side of the shaft portion 101. Here, the protrusion 102 protrudes longer than the protrusion 103 (see FIG. 19). A supporting recess portion 105 having a given depth is provided on the front side of the shaft portion 101. The supporting recess portion 105 includes a protrusion 105*a* for spring supporting that protrudes from the bottom face (see FIG. 18), and is arranged to house the coil spring 97 biasing the manipulation member 60*b* and support one end of the coil spring 97.

Figure 17A:
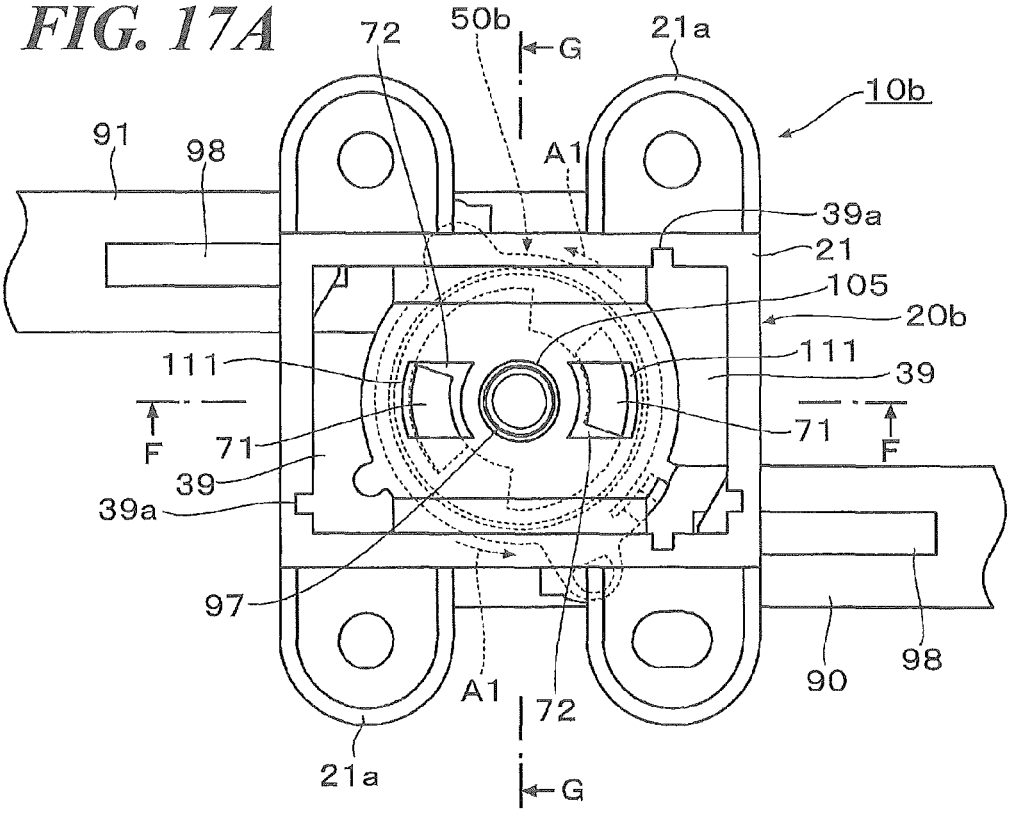
FIG. 17A is a front view thereof.
Figure 17B:
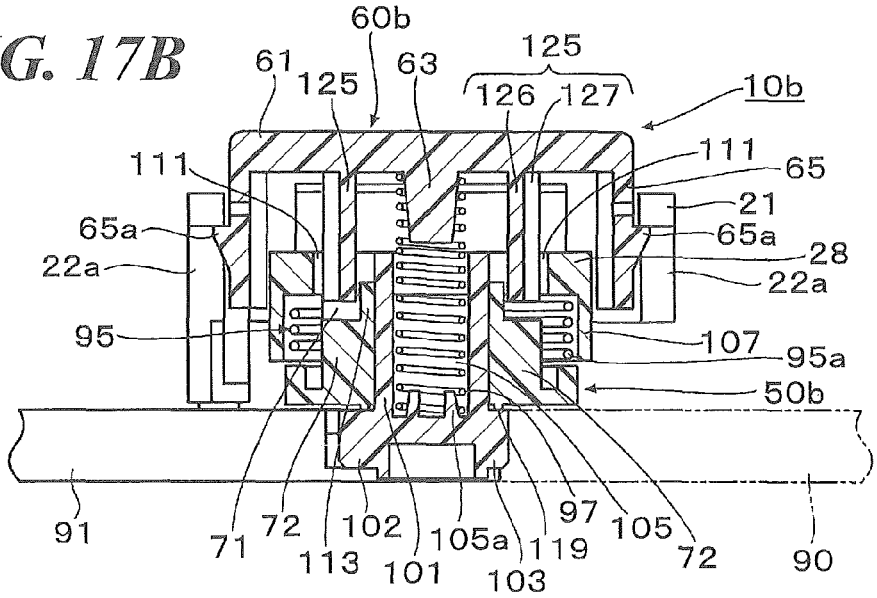
FIG. 17B is a cross-sectional view taken along the line F-F of FIG. 17A.
Figure 18:
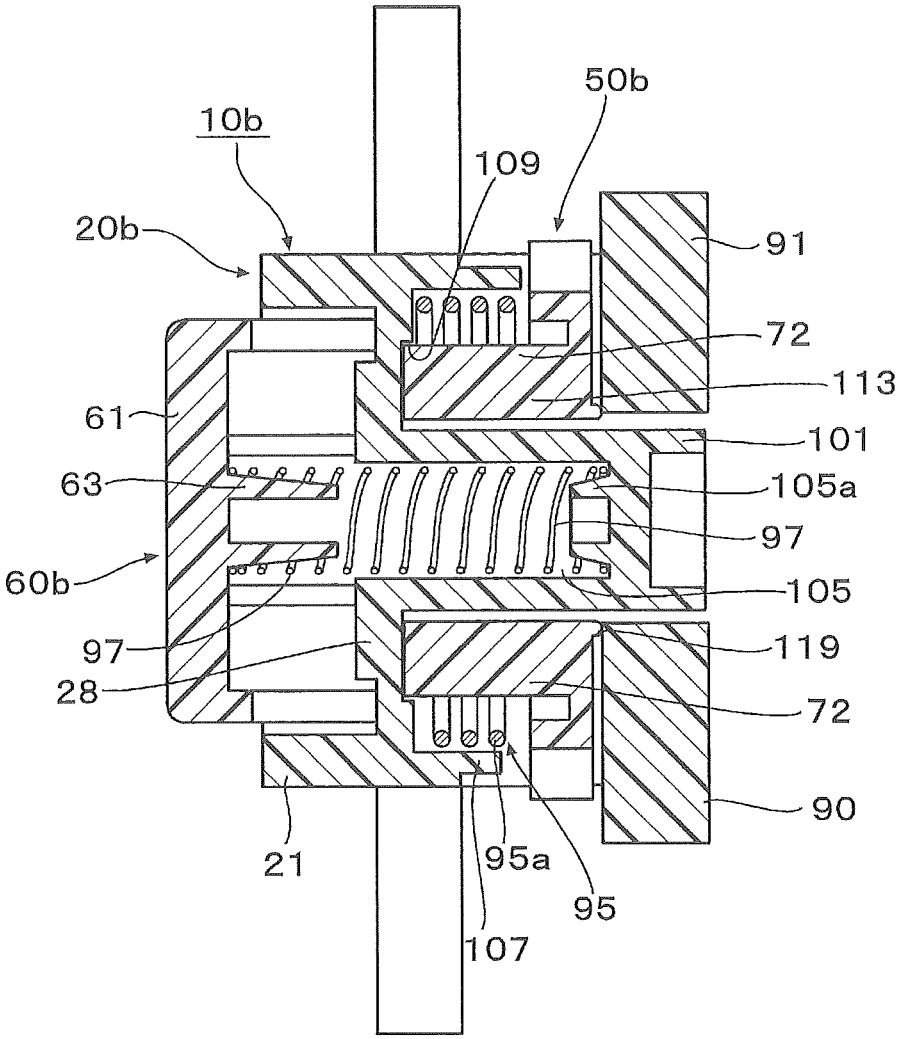
FIG. 18 A cross-sectional view taken along the line G-G of FIG. 17A.

A frame-shaped wall 107 erects from the circumference on the back side of the bottom portion 28, and the coil portion 95*a* of the torsion spring 95 is supported in contact with the inner circumferential face of the frame-shaped wall 107 (see FIG. 17B and FIG. 18). As shown in FIG. 15, on the frame-shaped wall 107, a spring locking portion 107*a* to which the other end portion 95*c* of the torsion spring 95 locks is provided at a given position in the circumferential direction, and a return-restriction portion 107*b* to restrict the rotary member 50 from returning after it has been mounted is provided at another position.

As shown in FIG. 18, a recess portion 109 to receive to rotatably support the distal end of the rotary member 50*b* is disposed on the back surface side of the bottom portion 28 of the housing 20*b* and on the inner circumference of the frame-shaped wall 107. Slide holes 111 and 111 to slide and guide the column-shaped cam contact portions 125 and 125 of the manipulation member 60*b* are provided to the bottom portion 28 of the housing 20*b* on both the sides of the shaft portion 101 (see FIG. 14 and FIGS. 17A and 17B).

Figure 19:
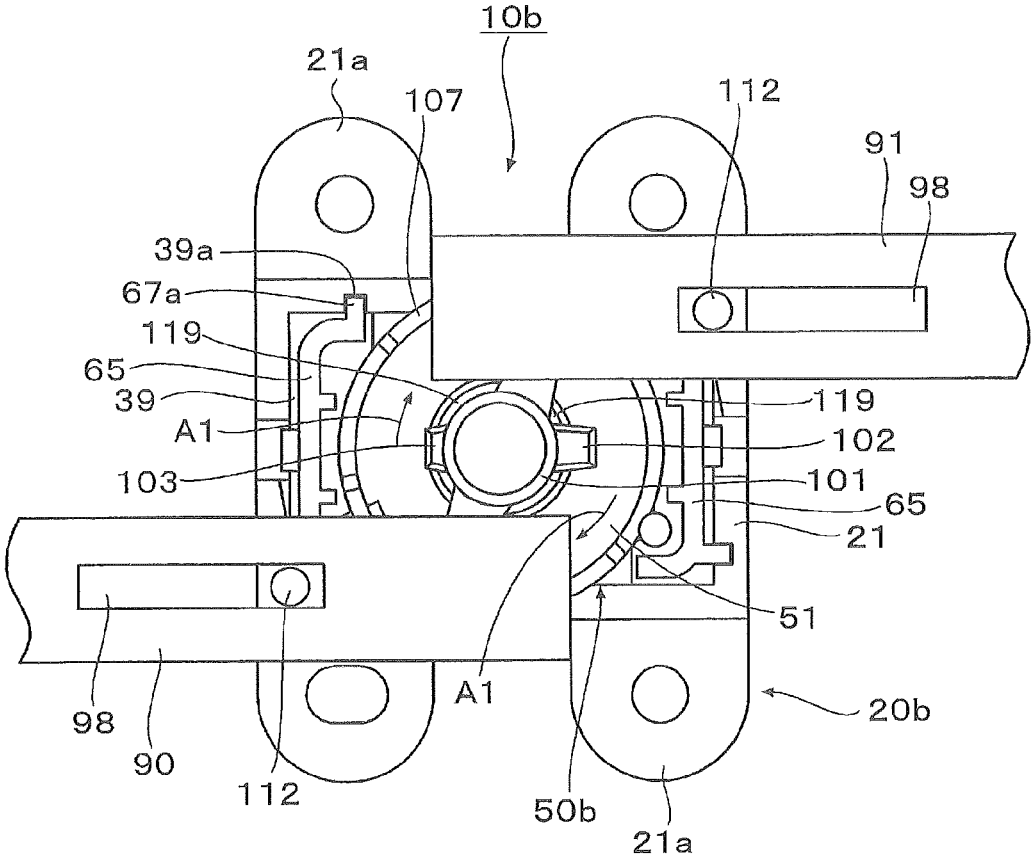

Rod guide protrusions 112 and 112 protruding from the back surface side of the peripheral wall 21 of the housing 20*b* (see FIG. 15) are inserted into slide holes 98 and 98 of the link rods 90 and 91 and slide and guide the link rods 90 and 91 (see FIG. 19).

Figure 20:
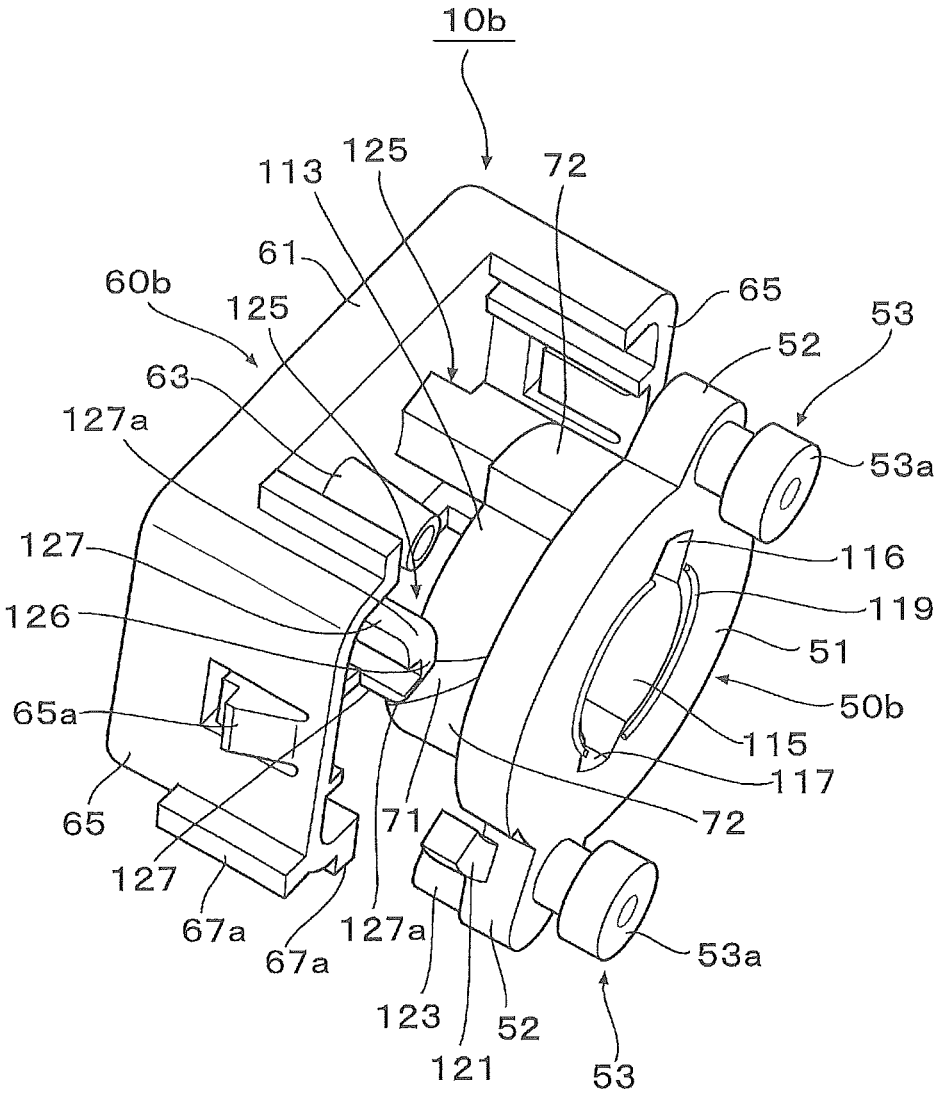
FIG. 20 A perspective view of the locking device in a state where the housing is removed.

As shown in FIG. 14, FIG. 15 and FIG. 20, the pair of wall portions 72 and 72 including the cam inclined surfaces 71, which are approximately same as the wall portions 70 of the manipulation member 60 according to the above-described embodiment, are provided to the rotary member 50*b* mounted on the back surface side of the housing 20*b* so as to erect from the front surface side of the rotary body 51. A cylindrical portion 113 protrudes from the inside diameter side of the wall portions 72, so as to be monolithic therewith.

A shaft hole 115 into which the shaft portion 101 of the housing 20*b* is inserted is provided to the rotary body 51 and the cylindrical portion 113. Groove portions 116 and 117 through which the protrusions 102 and 103 on the outer circumference of the distal end portion of the shaft portion 101 pass are provided at opposite positions in the circumferential direction so as to communicate with the shaft hole 115. The groove portion 116 is longer than the groove portion 117. The groove portion 116 functions as a portion through which the protrusion 102 passes while the groove portion 117 functions as a portion through which the protrusion 103 passes, which decide the direction in which the rotary member 50*b* is mounted.

Arc-shaped friction reduction ribs 119 and 119 protrude from the back surface side of the rotary body 51 on the circumference of the shaft hole 115 (see FIG. 20). A tongue-shaped return-restriction piece 121 protrudes from a lateral side of one of the extending portions 52 of the rotary body 51. A spring locking protrusion 123 to lock to one end portion 95*b* of the torsion spring 95 protrudes from the front surface of the same extending portion 52 (see FIG. 14 and FIG. 20).

As shown in FIG. 14, FIG. 15 and FIG. 20, the manipulation member 60*b* disposed on the front surface side of the housing 20*b* includes the column-shaped cam contact portions 125 and 125 on the back surface side of the pressing portion 611 on both the sides of the protrusion 63 for spring supporting, the cam contact portions 125 being brought into contact with the cam inclined surfaces 71 of the wall portions 72 of the rotary member 50*b*.

Each of the cam contact portions 125 includes a longitudinal rib 126 having a long and thin plate shape and a pair of lateral ribs 127, and 127 consecutively connected to the longitudinal rib 126 so as to expand in slanting directions from both the sides of the longitudinal rib 126, and has an approximately U shape when the manipulation member 60*b* is seen from the back surface side. Distal-end outer peripheral surfaces 127*a* of the lateral ribs 127 (see FIG. 20) have a round arc shape, and are brought into slidably contact with the cam inclined surfaces 71 of the wall portions 72 of the rotary member 50*b*.

Next, a description of operation and effect of the locking device 10*b* according to the present embodiment will be provided.

Figure 21:
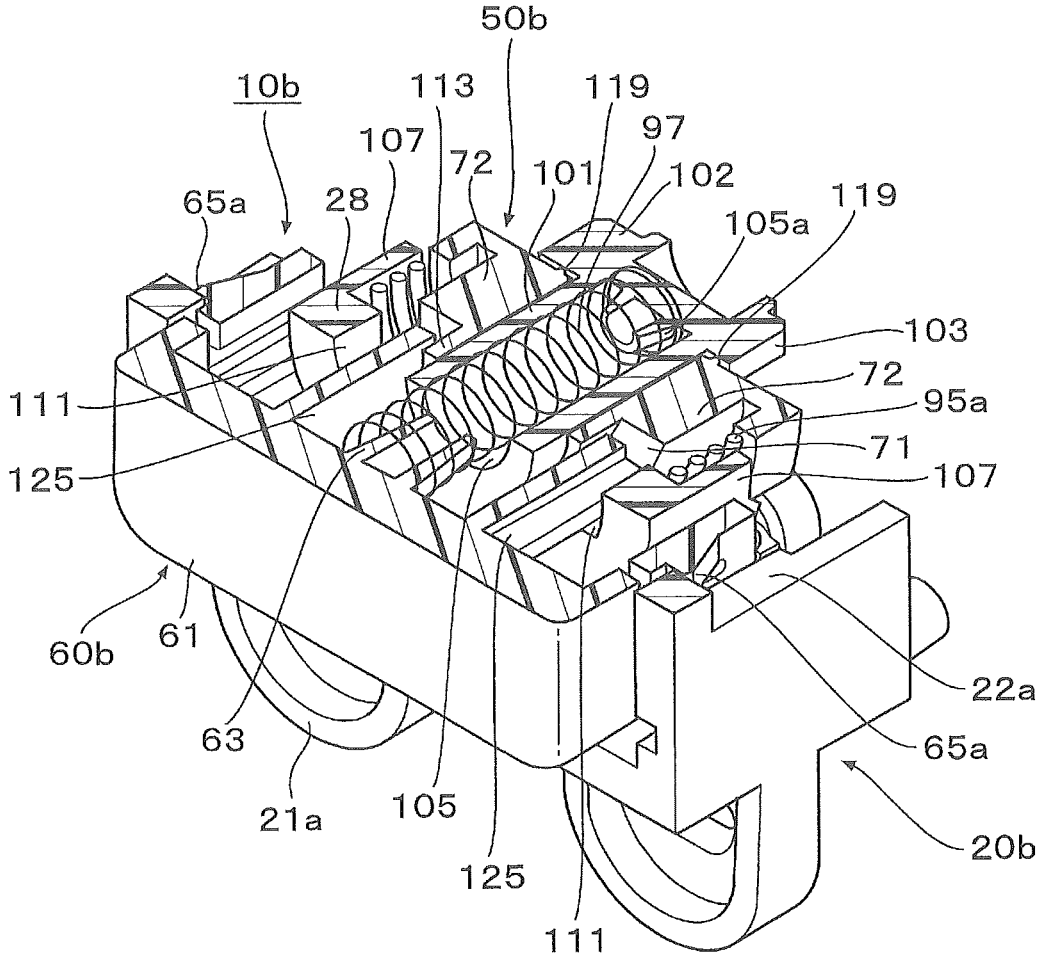
FIG. 21 A perspective cross-sectional view of the locking device.

For example, the locking device 10*b* is assembled as follows. To be specific, the coil spring 97 is housed in the supporting recess portion 105 of the housing 20*b*, and one end of the coil spring 97 is supported by the protrusion 105*a* for spring supporting while the other end is supported by the protrusion 63 for spring supporting of the manipulation member 60*b*. The manipulation member 60*b* is pushed into the housing 20*b* in this state, and the cam contact portions 125 and the locking pieces 65 of the manipulation member 60*b* are respectively inserted into the slide holes 111 and the guide holes 39 of the housing 20*b* while the locking hooks 65*a* and 65*a* are made to lock to one ends of the slits 22*a* and 22*a* of the housing 20*b*. Thus, as shown in FIG. 17A, FIG. 18 and FIG. 21, the manipulation member 60*b* can be pushably mounted to the housing 20*b* in a state where the manipulation member 60*b* is biased in a direction away from the housing 20*b* by the coil spring 97.

Then, the coil portion 95*a* of the torsion spring 95 is disposed inside of the frame-shaped wall 107 of the housing 20*b* to be supported in contact with the inner circumferential face of the frame-shaped wall 107 while the other end portion 95*c* is made to lock to the spring locking portion 107*a* of the housing 20*b* (see FIG. 15).

Next, the protrusions 102 and 103 of the shaft portion 101 are matched to the groove portions 116 and 117 of the rotary member 50*b*, and the shaft portion 101 is inserted into the shaft hole 115 of the rotary member 50*b* until the protrusions 102 and 103 appear from the back side of the groove portions 116 and 117. The distal end portion of the rotary member 50*b* is inserted into the recess portion 109 of the housing 20*b*. The one end portion 95*b* of the torsion spring 95 is made to lock to the spring locking protrusion 123 of the rotary member 50*b* to rotate the rotary member 50*b* in a given direction (here, the arrow A3 direction in FIG. 15) in this state. In FIG. 15, the rotary member 50*b* is illustrated as if it is in the state of being mounted to the housing 20*b* for the sake of convenience.

Then, while making the one end portion 95*b* of the torsion spring 95 caught by the spring locking protrusion 123, the rotary member 50*b* is rotated against the biasing force of the torsion spring 95. By rotating the rotary member 50*b* until the return-restriction piece 121 locks to the return-restriction portion 107*b* of the frame-shaped wall 107 (see FIG. 15), the protrusions 102 and 103 of the shaft portion 101 engage the friction reduction ribs 119 and 119 on the circumference on the back side of the shaft hole 115 of the rotary member 50*b*. Thus, the rotary member 50*b* can be mounted to the back surface side of the housing 20*b* while retained.

As described above, because the simple work of rotating the rotary member 50*b* in the given direction after letting the protrusions 102 and 103 out of the groove portions 116 and 117, and making the protrusions 102 and 103 engage the back surface side of the housing 20*b* allows the rotary member 50*b* to be rotatably mounted to the housing 20*b* while retained in the present embodiment, the workability in mounting the rotary member 50*b* to the housing 20*b* can be improved.

As shown in FIG. 17A and FIG. 21, in the present embodiment, because the protrusions 102 and 103 of the shaft portion 101 are arranged to engage the arc-shaped friction reduction ribs 119 and 119 protruding from the circumference of the shaft hole 115 on the back side surface of the rotary member 51, friction resistance produced in rotating the rotary member 50*b* can be reduced.

In the above-described state, the rotary member 50*b* is biased to be rotated in the arrow A1 direction (see FIG. 19) by the torsion spring 95, and thereby the pair of link rods 90 and 91 are biased in the directions of engaging the locking portions 3 and 3 of the glove box 1 such that the hook portions 92 and 92 move away from each other (see FIGS. 9A and 9B).

As shown in FIG. 17B, FIG. 18 and FIG. 21, in the present embodiment, because the one end of the coil spring 97 is housed in and supported by the supporting recess portion 105 of the shaft portion 101, the locking device 10*b* can be thinned while the length of the coil spring 97 can be secured.

Figure 22A:
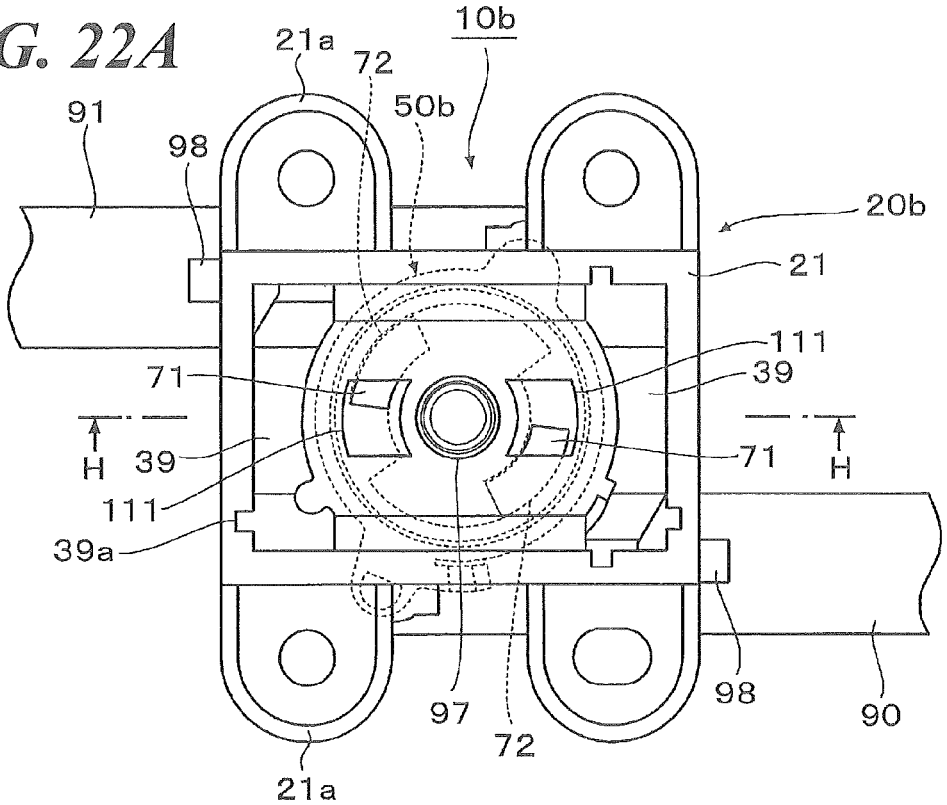
FIG. 22A is a front view thereof.
Figure 22B:
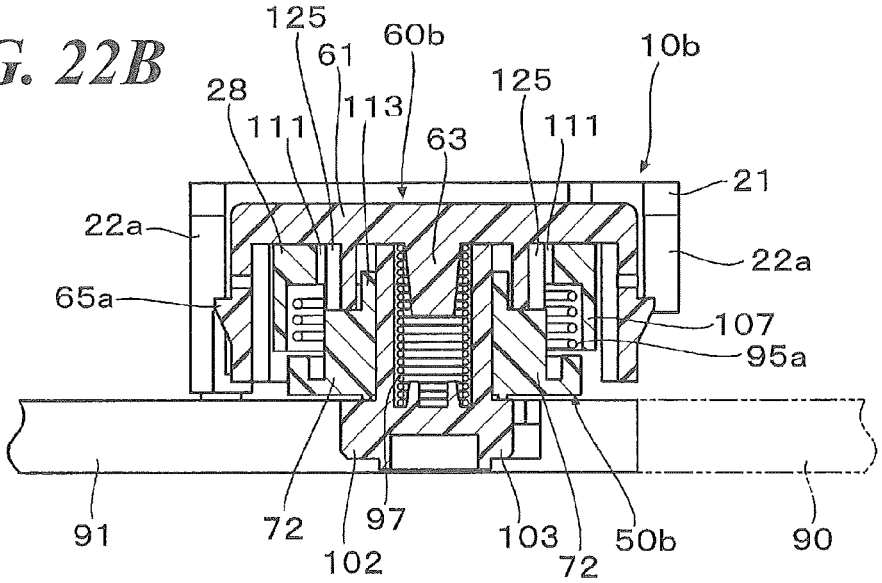
FIG. 22B is a cross-sectional view taken along the line H-H of FIG. 22A.

As shown in FIGS. 22A and 22B, in the locking device 10*b*, when the manipulation member 60*b* is pushed into the housing 20 against the biasing force of the coil spring 97, the cam inclined surfaces 71 and 71 of the wall portions 72 of the rotary member 50*b* are pressed by the cam contact portions 125 and 125 of the manipulation member 60*b*, and while the distal-end outer peripheral surfaces 127*a* of the lateral ribs 127 of the cam contact portions 125 (see FIG. 20) slide in contact on the cam inclined surfaces 71, the rotary member 50*b* is rotated against the rotational biasing force of the torsion spring 95. Then, when the hook portions 92 and 92 of the pair of link rods 90 and 91 slide to the positions of not being engaged with the locking portions 3 and 3 of the glove box 1, the lid 5 can be opened from the opening portion 2 of the glove box 1.

At this time, because the cylindrical portion 113 are disposed on the rotary member 50*b* at the inside diameter side of the wall portions 72 having the cam inclined surfaces 71 and 71 so as to be monolithic therewith, and the cylindrical portion 113 guides the cam contact portions 125 when the manipulation member 60*b* is pushed in and the cam contact portions 125 moves sliding in contact on the cam inclined surfaces 71 in the present embodiment, smooth rotation of the rotary member can be achieved (see FIG. 17B and FIG. 20).

As shown in FIG. 17B, FIG. 18 and FIG. 21, because the coil portion 95*a* of the torsion spring 95 is supported in contact with the inner circumferential face of the frame-shaped wall 107 erecting from the back surface of the housing 20*b* while not being in contact with the outer peripheral surfaces of both the wall portions 72 and 72 of the rotary member 50*b*, a spring force (rotational biasing force) and a frictional force produced by the coil portion 95*a* can be prevented from acting on the rotary member 50*b* when the rotary member 50*b* is being rotated, which allows smooth rotation of the rotary member 50*b*.

Having a round arc shape, the distal-end outer peripheral surfaces 127*a* of the lateral ribs 127 of the cam contact portions 125 of the manipulation member 60*b* can move sliding in contact on the cam inclined surfaces 71 of the rotary member 50*b*, which allows smoother rotational movement of the rotary member 50*b*.

In the locking device 10*b*, because the rotary member 50*b* is rotatably mounted to the back surface side of the housing 20*b*, the rotary member 50*b* can be prevented from interfering with the peripheral wall 21 of the housing 20*b* while the outside diameter of the rotary member 50*b* can be increased. As a result, the radius gyration of the connecting portion between the rotary member 50*b* and the link rods 90 and 91 can be increased to increase the sliding amount of the link rods 90 and 91 with respect to the rotational angle of the rotary member 50*b*. Thus, even if the push-in amount of the manipulation member 60*b* is reduced, the stroke amount of the link rods 90 and 91 can be secured, so that the entire locking device 10*b* can be thinned.

Because no cam contact portions are provided to the rotary member 50*b* but the cam contact portions 125 are provided to the manipulation member 60*b* in the present embodiment, it is essential only to provide the relatively small slide holes 111 to slide the cam contact portions 125 back and forth to the wall portion (the bottom portion 28) on the back surface side of the housing 20*b*, and thereby, the stiffness of the wall portion on the back surface side of the housing 20*b* can be increased (if cam contact portions are provided to the rotary member, it is necessary to provide relatively large holes to rotatably receive the cam contact portions to the wall portion on the back surface side of the housing).

Figure 23:
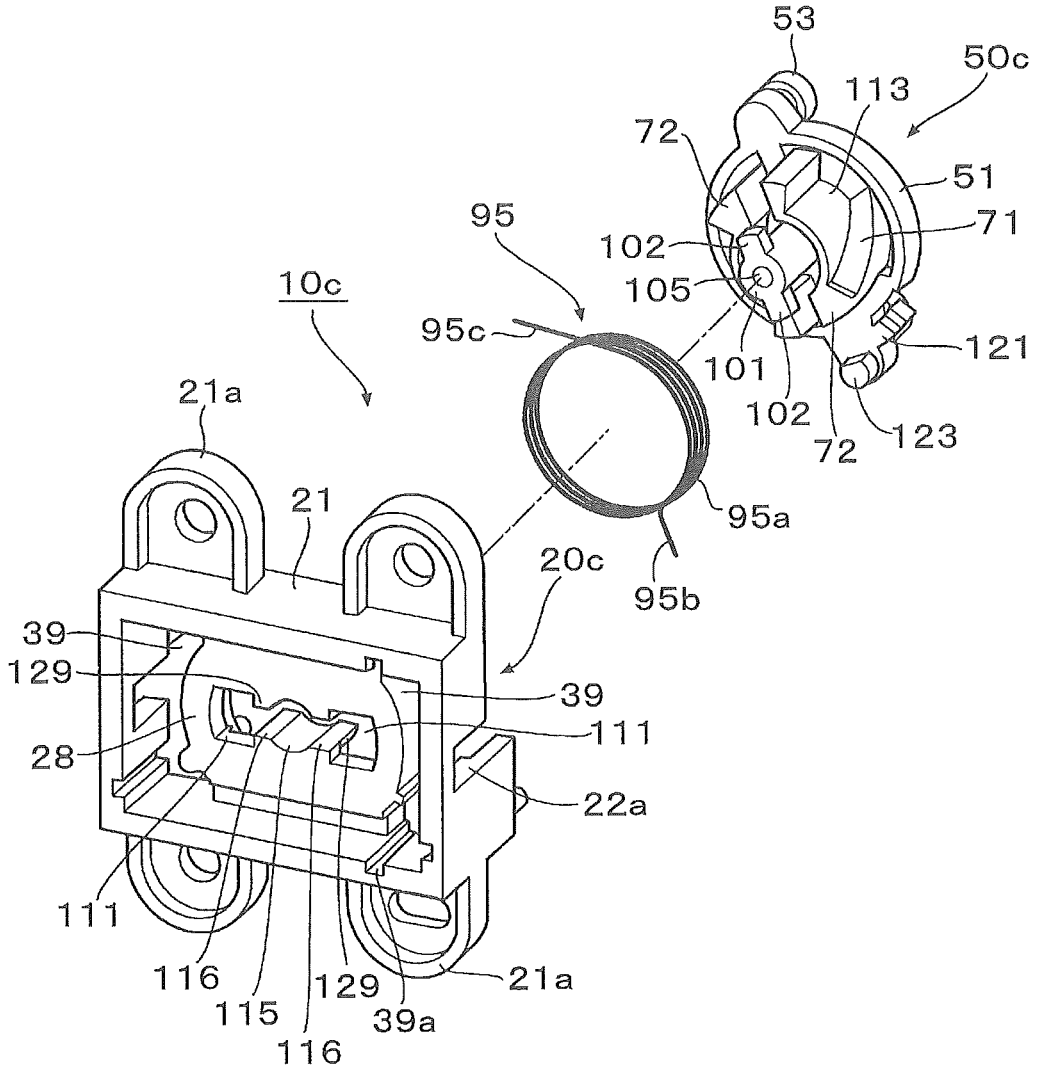
FIG. 23 An exploded perspective view of a locking device for an openable/closable body according to the fourth embodiment of the present invention.
Figure 24:
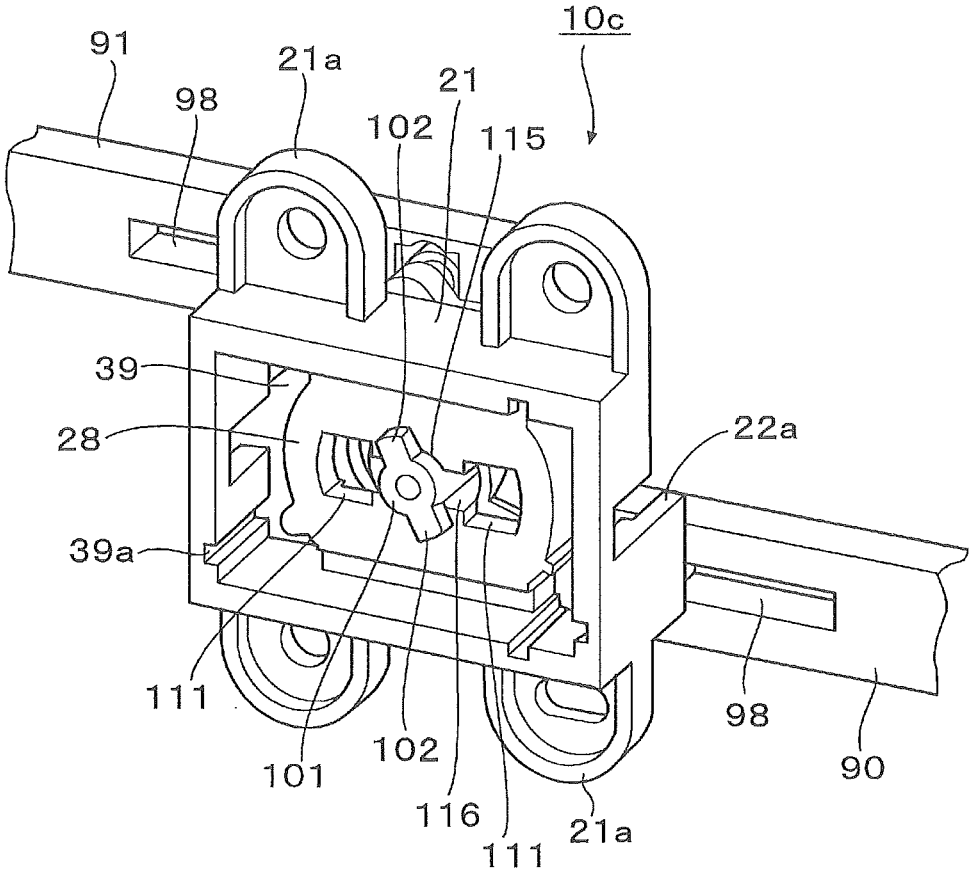
FIG. 24 A perspective view of the locking device in a state where a rotary member is mounted to the housing.

A locking device for an openable/closable body according to the fourth embodiment of the present invention is illustrated in FIG. 23 and FIG. 24. The same reference numerals are provided to the components that are substantially same as those in the above-described embodiment, and explanations of those components are omitted.

The locking device 10*c* for an openable/closable body according to the present embodiment (hereinafter, referred to as the "locking device 10*c*") is the same in essential structure as the above-described third embodiment, but different from the third embodiment in that the shaft portion 101 is disposed on the side of a rotary member 50*c* while the shaft hole 115 for shaft portion insertion is provided to a housing 20*c*.

To be specific, the shaft portion 101 erects from the center on the front surface side of the rotary body 51 inside of the wall portions 72 and 72 and the cylindrical portion 113 of the rotary member 50*c*. Protrusions 102 and 102 having the same shape protrude from the opposite positions on the outer circumference of the distal end of the shaft portion 101.

The shaft hole 115 into which the shaft portion 101 is inserted is provided between the slide holes 111 and 111 in the center of the bottom portion 28 of the housing 20*c*. Groove portions 116 and 116 through which the protrusions 102 and 102 of the shaft portion 101 pass are provided on both the sides of the shaft hole 115 so as to communicate with the slide holes 111. Arc-shaped supporting walls 129 and 129 protrude from the circumference on the back side of the shaft hole 115 and the groove portions 116 and 116, and are arranged to rotationally support the shaft portion 101 inserted into the shaft hole 115.

The protrusions 102 and 102 of the shaft portion 101 are matched to the groove portions 116 and 116 of the housing 20*c*, and the shaft portion 101 is inserted into the shaft hole 115 of the housing 20*c* to let the protrusions 102 and 102 out of the front side of the groove portions 116 and 116. Then, the rotary member 50*c* is rotated in a given direction, and thereby the rotary member 50*c* can be rotatably mounted to the back surface side of the housing 20*c* while being retained (see FIG. 24).

It is also possible to provide a pair of protrusions having different shapes that protrude from the outer circumference of the distal end of the shaft portion 101 (for example, one protrusion is narrow in width) like the above-described third embodiment, and a pair of groove portions disposed on both the sides of the shaft hole 115 that correspond to the protrusions, and thereby the mounting direction can be decided.

Figure 25:
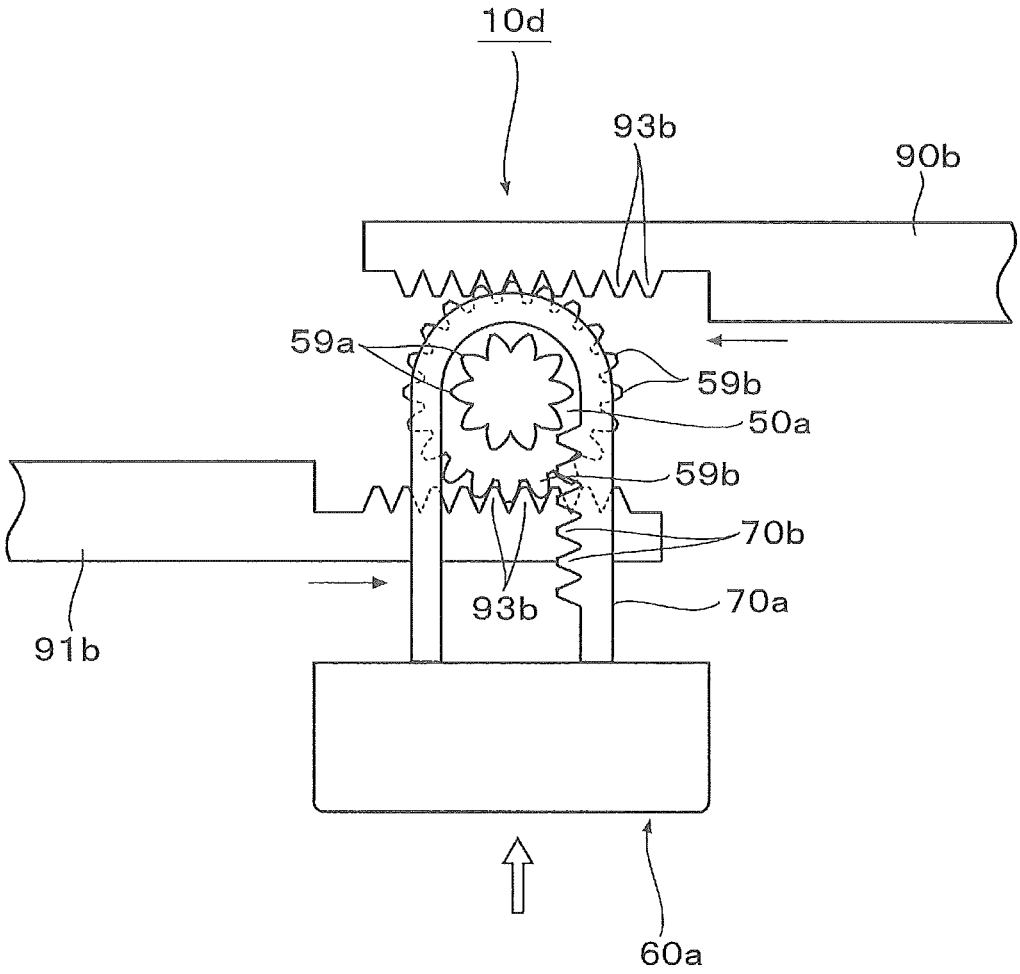
FIG. 25 An enlarged explanatory view of relevant components of a locking device for an openable/closable body relating to the present invention.

A locking device for an openable/closable body relating to the present invention is illustrated in FIG. 25. The same reference numerals are provided to the components that are substantially same as those in the above-described embodiment, and explanations of those components are omitted.

A locking device 10*d* for an openable/closable body (hereinafter, referred to as the "locking device 10*d*") includes a rotary member 50*a* having a two-step gear shape that includes a small-diameter gear 59*a* and a large-diameter gear 59*b*, and the rotary member 50*a* is rotatably supported by the fixed body or the openable/closable body. A pair of link rods 90*b* and 91*b* including rack grooves 93*b* at the base ends are arranged to slidably move in synchronization with the rotational movement of the rotary member 50*a* while the rack grooves 93*b* and 93*b* are brought into engagement with the large-diameter gear 59*b* of the rotary member 50*a*. A spur gear 70*b* is provided to the inner surface of a U-shaped wall portion 70*a* extending from the back side of the manipulation member 60*a*. The small-diameter gear 59*a* of the rotary member 50*a* is disposed inside the wall portion 70*a*, and the manipulation member 60*a* is pushably mounted to a housing (not illustrated). One of the link rods 90*b* and 91*b* is biased by a spring (not illustrated) to slide in the direction that the hook portion engages the locking portion.

When the manipulation member 60*a* is pushed into the housing (not illustrated), the spur gear 70*b* inside the wall portion 70*a* is brought into engagement with the small-diameter gear 59*a* of the rotary member 50*a* to rotate the rotary member 50*a*. Thus, the pair of link rods 90*b* and 91*b* that are in engagement with the large-diameter gear 59*b* of the rotary member 50*a* via the rack grooves 93*b* slide in the directions that the hook portions are not engaged with the locking portions against the biasing force of the spring (not illustrated).

In the above-described embodiments, the locking devices are applied to the configurations that the lid 5 is openably/closably mounted to the opening portion 2 of the glove box 1; however, the present invention is not limited to these configurations. For example, the locking devices may be applied to a configuration that a glove box is mounted rotationally movable to an opening portion of an instrument panel (the instrument panel functions as the "fixed body", and the glove box functions the "openable/closable body"), a configuration that a lid is openably/closably mounted to an opening portion of an instrument panel (the instrument panel functions as the "fixed body", and the lid functions as the "openable/closable body"), or the like. The locking devices can be applied to a variety of openable/closable bodies arranged to open and close opening portions of fixed bodies.

DESCRIPTION OF REFERENCE NUMERALS AND SIGNS

1 Glove box (fixed body)
2 Opening portion
3, 3*a* Locking portion
5, 5*a* Lid (openable/closable body)
6 Panel
10, 10*a*, 10*b*, 10*c* Locking device
20, 20*b*, 20*c* Housing
50, 50*b*, 50*c* Rotary member
55 Cam protrusion
55*a* Distal end face
60, 60*b* Manipulation member
70, 72 Wall portion
80 Bezel
85 Key cylinder
90, 91 Link rod
92 Hook portion
93 Fitting recess portion
95 Torsion spring
97 Coil spring
101 Shaft portion
102, 103 Protrusion
115 Shaft hole
116, 117 Groove portion
125 Cam contact portion

The invention claimed is:

1. A locking device for an openable/closable body that is openably/closably mounted to an opening portion of a fixed body, the locking device including:

locking portions provided on both sides of one of the openable/closable body and the opening portion of the fixed body;

a housing mounted to the other one of the openable/closable body and the fixed body and including a cylinder-shaped shaft portion protruding from a back surface side of the housing;

a rotary member rotatably mounted on the back surface side of the housing around the shaft portion;

a pair of link rods configured to slidably move in synchronization with rotation of the rotary member to make hook portions formed at distal ends thereof engage and disengage the locking portions;

a spring arranged to bias the link rods in directions that the hook portions of the link rods engage the locking portions; and a manipulation member pushably mounted on a front surface side of the housing and including a pressing portion configured to be pushed in from a front side of the pressing portion and a protrusion protruding from a back side of the pressing portion, wherein one of the rotary member and the manipulation member includes a wall portion having a cam inclined surface, and the other one of the rotary member and the manipulation member includes a cam contact portion, so that a pushing force on the manipulation member is converted into a rotational force on the rotary member through contact between the cam contact portion and the cam inclined surface, wherein, by pushing in the manipulation member, the rotary member is rotated against a biasing force of the spring, and the pair of link rods are made to slide to positions where the hook portions of the link rods disengage the locking portions, wherein, in a state where the manipulation member is pushed in, the protrusion is movable within the shaft portion.

2. The locking device of claim 1, wherein the cam contact portion is disposed in plurality on at least two positions at regular intervals in the circumferential direction with respect to a rotation center of the rotary member.

3. The locking device of claim 1, wherein the wall portion has one of an arc shape and a circular cylindrical shape when seen in a rotation axis direction of the rotary member, and the cam inclined surface is formed by an end face of the wall portion which gradually becomes lower in height along the circumferential direction.

4. The locking device of claim 1, wherein one of the housing and the rotary member includes:

a shaft portion protruding therefrom; and a protrusion protruding from an outer circumference of a distal end portion of the shaft portion toward an outside diameter side of the shaft portion, wherein the other one of the housing and the rotary member includes:

a shaft hole into which the shaft portion is inserted; and a groove portion that communicates with the shaft hole and allows the protrusion to pass therethrough, and wherein the rotary member is retained by matching the protrusion to the groove portion, inserting the shaft portion into the shaft hole, in a state where the protrusion appears from the groove portion, rotating the rotary member in a given direction to thereby make the protrusion engage a circumference of the shaft hole.

5. The locking device of claim 4, further including:

a coil spring provided to bias the manipulation member in a direction away from the housing, wherein the shaft portion includes a supporting recess portion arranged to support one end of the coil spring.

6. The locking device of claim 1, wherein the cam contact portion has an arc-shaped distal end face that is to be brought into contact with the cam inclined surface.

7. A locking device for an openable/closable body that is openably/closably mounted to an opening portion of a fixed body, the locking device including:

locking portions provided on both sides of one of the openable/closable body and the opening portion of the fixed body;

a housing mounted to the other one of the openable/closable body and the fixed body;

a rotary member rotatably mounted to the housing;

a pair of link rods configured to slidably move in synchronization with rotation of the rotary member to make hook portions formed at distal ends thereof engage and disengage the locking portions;

a spring arranged to bias the link rods in directions that the hook portions of the link rods engage the locking portions; and a manipulation member pushably mounted to the housing, wherein one of the rotary member and the manipulation member includes a wall portion having a cam inclined surface, while the other one of the rotary member and the manipulation member includes a cam contact portion, so that a pushing force on the manipulation member is converted into a rotational force on the rotary member through contact between the cam contact portion and the cam inclined surface, wherein, by pushing in the manipulation member, the rotary member is rotated against a biasing force of the spring, and the pair of link rods are made to slide to positions where the hook portions of the link rods disengage the locking portions, and wherein the housing defines a pit portion having a square frame shape, and the rotary member is rotatably mounted within the pit portion so as to be interposed between the housing and the manipulation member.

8. The locking device of claim 7, wherein the wall portion having the cam inclined surface is provided on the manipulation member while the cam contact portion is provided on the rotary member.

9. A locking device for an openable/closable body that is openably/closably mounted to an opening portion of a fixed body, the locking device including:

locking portions provided on both sides of one of the openable/closable body and the opening portion of the fixed body;

a housing mounted to the other one of the openable/closable body and the fixed body;

a rotary member rotatably mounted to the housing;

a pair of link rods configured to slidably move in synchronization with rotation of the rotary member to make hook portions formed at distal ends thereof engage and disengage the locking portions;

a spring arranged to bias the link rods in directions that the hook portions of the link rods engage the locking portions; and a manipulation member pushably mounted to the housing, wherein one of the rotary member and the manipulation member includes a wall portion having a cam inclined surface, while the other one of the rotary member and the manipulation member includes a cam contact portion, so that a pushing force on the manipulation member is converted into a rotational force on the rotary member through contact between the cam contact portion and the cam inclined surface, wherein, by pushing in the manipulation member toward the housing, the rotary member is rotated against a biasing force of the spring, and the pair of link rods are made to slide to positions where the hook portions of the link rods disengage the locking portions, wherein the pair of link rods are pivotally mounted to the rotary member at opposite positions around the outer circumference of the rotary member, and wherein, in a state where the manipulation member is not pushed toward the housing, the cam contact portion abuts an upper part of the wall portion to thereby being limited from rotating due to the biasing force of the spring.

10. A locking device for an openable/closable body that is openably/closably mounted to an opening portion of a fixed body, the locking device comprising:

locking portions provided on both sides of one of the openable/closable body and the opening portion of the fixed body;

a housing mounted to the other one of the openable/closable body and the fixed body;

a rotary member rotatably mounted to the housing;

a pair of link rods configured to slidably move in synchronization with rotation of the rotary member to make hook portions formed at distal ends thereof engage and disengage the locking portions;

a spring arranged to bias the link rods in directions that the hook portions of the link rods engage the locking portions; and a manipulation member pushably mounted to the housing, wherein one of the rotary member and the manipulation member includes a wall portion having a cam inclined surface, while the other one of the rotary member and the manipulation member includes a cam contact portion, so that a pushing force on the manipulation member is converted into a rotational force on the rotary member through contact between the cam contact portion and the cam inclined surface, wherein, by pushing in the manipulation member, the rotary member is rotated against a biasing force of the spring, and the pair of link rods are made to slide to positions where the hook portions of the link rods disengage the locking portions, wherein one of the housing and the rotary member includes:

a shaft portion protruding therefrom; and a protrusion protruding from an outer circumference of a distal end portion of the shaft portion toward an outside diameter side of the shaft portion, wherein the other one of the housing and the rotary member includes:

a shaft hole into which the shaft portion is inserted; and a groove portion that communicates with the shaft hole and allows the protrusion to pass therethrough, and wherein the rotary member is retained by:

matching the protrusion to the groove portion, inserting the shaft portion into the shaft hole, and in a state where the protrusion appears from the groove portion, rotating the rotary member in a given direction to thereby make the protrusion engage a circumference of the shaft hole.

11. The locking device of claim 10, further including:

a coil spring provided to bias the manipulation member in a direction away from the housing, wherein the shaft portion includes a supporting recess portion arranged to support one end of the coil spring.

12. A locking device for an openable/closable body that is openably/closably mounted to an opening portion of a fixed body, the locking device including:

locking portions provided on both sides of one of the openable/closable body and the opening portion of the fixed body;

a housing mounted to the other one of the openable/closable body and the fixed body;

a rotary member rotatably mounted to the housing;

a pair of link rods configured to slidably move in synchronization with rotation of the rotary member to make hook portions formed at distal ends thereof engage and disengage the locking portions;

a spring arranged to bias the link rods in directions that the hook portions of the link rods engage the locking portions; and a manipulation member pushably mounted to the housing, wherein one of the rotary member and the manipulation member includes a wall portion having a cam inclined surface, while the other one of the rotary member and the manipulation member includes a cam contact portion, so that a pushing force on the manipulation member is converted into a rotational force on the rotary member through contact between the cam contact portion and the cam inclined surface, wherein, by pushing in the manipulation member, the rotary member is rotated against a biasing force of the spring, and the pair of link rods are made to slide to positions where the hook portions of the link rods disengage the locking portions, wherein one of the wall portion or the cam contact portion included on the rotary member protrudes from a face of the rotary member in a direction of the manipulation member, and wherein one of the rotary member and the manipulation member includes a column portion connected to the wall portion on an out periphery of the wall portion, and wherein an upper end of the column portion includes a shape that protrudes higher than a highest portion of the cam inclined surface.

13. The locking device of claim 12, wherein a cylindrical portion is provided on the one of the rotary member and the manipulation member at one of an inside diameter side and an outside diameter side of the wall portion having the cam inclined surface, so as to be monolithic therewith, and wherein the cylindrical portion guides the cam contact portion when the manipulation member is pushed in to bring the cam contact portion into contact with the cam inclined surface to thereby rotate the rotary member.

14. The locking device of claim 12, wherein, when the rotary member is rotated to a furthest rotation position against the biasing force of the spring, the one of the cam inclined surface and the cam contact portion of the manipulation member is elevated from the face of the rotary member in the direction of the manipulation member.

15. The locking device of claim 12, wherein the cam inclined surface extends an entire length of the wall portion.

16. The locking device of claim 15, wherein the column portion contacts the cam contact portion in a state where the manipulation member is not pushed into the housing.

17. The locking device of claim 12, wherein the column portion contacts the cam contact portion in a state where the manipulation member is not pushed into the housing.

* * * * *